US011389818B2

(12) United States Patent
Okuda et al.

(10) Patent No.: US 11,389,818 B2
(45) Date of Patent: Jul. 19, 2022

(54) SURFACE TREATMENT APPARATUS AND SURFACE TREATMENT METHOD

(71) Applicant: C. Uyemura & Co., Ltd., Osaka (JP)

(72) Inventors: Tomoji Okuda, Hirakata (JP); Daisuke Matsuyama, Hirakata (JP); Shinji Tachibana, Hirakata (JP); Masayuki Utsumi, Hirakata (JP)

(73) Assignee: C. UYEMURA & CO., LTD., Osaka (JP)

( * ) Notice: Subject to any disclaimer, the term of this patent is extended or adjusted under 35 U.S.C. 154(b) by 186 days.

(21) Appl. No.: 16/648,086

(22) PCT Filed: Aug. 23, 2018

(86) PCT No.: PCT/JP2018/031065
§ 371 (c)(1),
(2) Date: Mar. 17, 2020

(87) PCT Pub. No.: WO2019/058860
PCT Pub. Date: Mar. 28, 2019

(65) Prior Publication Data

US 2020/0276608 A1 Sep. 3, 2020

(30) Foreign Application Priority Data

Sep. 20, 2017 (JP) ..... JP2017-180414

(51) Int. Cl.
*B05C 3/04* (2006.01)
*B05B 3/02* (2006.01)
(Continued)

(52) U.S. Cl.
CPC ..... *B05C 3/04* (2013.01); *B05B 3/02* (2013.01); *C25D 5/08* (2013.01); *C25D 7/00* (2013.01);
(Continued)

(58) Field of Classification Search
None
See application file for complete search history.

(56) References Cited

U.S. PATENT DOCUMENTS 1,431,022 A 10/1922 Mumford, Jr.
4,304,641 A 12/1981 Grandia et al.
(Continued)

FOREIGN PATENT DOCUMENTS

JP 56-042976 4/1981
JP 62-274093 11/1987
(Continued)

OTHER PUBLICATIONS

Office Action dated May 18, 2021 issued in corresponding Japanese Patent Application No. 2017-180414, with Machine English Translation, 13 pages.
(Continued)

*Primary Examiner* — Louis J Rufo
(74) *Attorney, Agent, or Firm* — Wenderoth, Lind & Ponack, L.L.P.

(57) ABSTRACT

A surface treatment apparatus for subjecting a workpiece immersed at least partly in a solution to a surface treatment has: a spray nozzle facing the workpiece for spraying a treatment solution towards a working surface of the workpiece. The surface treatment apparatus has at least one of: a spray nozzle rotator to rotate the spray nozzle in a plane parallel to the working surface of the workpiece; or a workpiece rotator to rotate the workpiece in a plane perpendicular to a spraying direction of the treatment solution sprayed from the spray nozzle.

8 Claims, 12 Drawing Sheets

(51) Int. Cl.

| | |
|---|---|
| ***C25D 5/08*** | (2006.01) |
| ***C25D 17/08*** | (2006.01) |
| ***C25D 21/10*** | (2006.01) |
| ***C25D 7/00*** | (2006.01) |
| ***C25D 7/12*** | (2006.01) |

(52) U.S. Cl.
CPC ..... *C25D 7/12* (2013.01); *C25D 17/08* (2013.01); *C25D 21/10* (2013.01)

(56) References Cited

U.S. PATENT DOCUMENTS

| | | | | |
|---|---|---|---|---|
| 5,421,987 | A * | 6/1995 | Tzanavaras | C25D 5/08 205/133 |
| 6,685,817 | B1 | 2/2004 | Mathieu | |
| 2004/0084318 | A1* | 5/2004 | Cohen | C25D 7/123 257/E21.174 |
| 2006/0113185 | A1 | 6/2006 | Kuriyama et al. | |
| 2010/0176004 | A1 | 7/2010 | Schneider et al. | |
| 2011/0073482 | A1 | 3/2011 | Kuriyama et al. | |
| 2013/0001087 | A1 | 1/2013 | Asa et al. | |
| 2014/0151239 | A1 | 6/2014 | Kobayashi et al. | |
| 2018/0265999 | A1* | 9/2018 | Weinhold | C25D 17/06 |

FOREIGN PATENT DOCUMENTS

| | | | |
|---|---|---|---|
| JP | 11-328749 | | 11/1999 |
| JP | 2002-266098 | | 9/2002 |
| JP | 2004-359994 | | 12/2004 |
| JP | 2005-097732 | | 4/2005 |
| JP | 2010-530029 | | 9/2010 |
| JP | 2013-011004 | | 1/2013 |
| KR | 2014137164 | A * | 12/2014 |
| KR | 10-1494175 | | 2/2015 |

OTHER PUBLICATIONS

Partial Supplementary European Search Report dated May 19, 2021 issued in corresponding European Patent Application No. 18858558.2, 15 pages.

Office Action dated Jul. 30, 2021 in corresponding Chinese Patent Application No. 201880059714.6, with English Machine Translation, 12 pages.

Office Action dated Sep. 7, 2021 in corresponding Japanese Patent Application No. 2017-180414, with English Machine Translation, 6 pages.

Search Report dated Feb. 23, 2021 in corresponding Singapore Patent Application No. 11202002497Q.

Written Opinion dated Feb. 23, 2021 in corresponding Singapore Patent Application No. 11202002497Q.

International Search Report dated Oct. 16, 2018 in International (PCT) Application No. PCT/JP2018/031065.

Office Action dated Mar. 12, 2021 in corresponding Taiwanese Application No. 107131845, with English Translation.

Office Action dated Oct. 17, 2021 in corresponding Korean Patent Application No. 10-2020-7010776, with Machine English Translation, 15 pages.

Office Action dated Mar. 1, 2022 issued in corresponding Singapore Patent Application No. 11202002497Q, 7 pages.

Office Action dated Jan. 26, 2022 issued in corresponding Chinese Patent Application No. 201880059714.6, with English machine translation, 11 pages.

* cited by examiner

[FIG. 1]
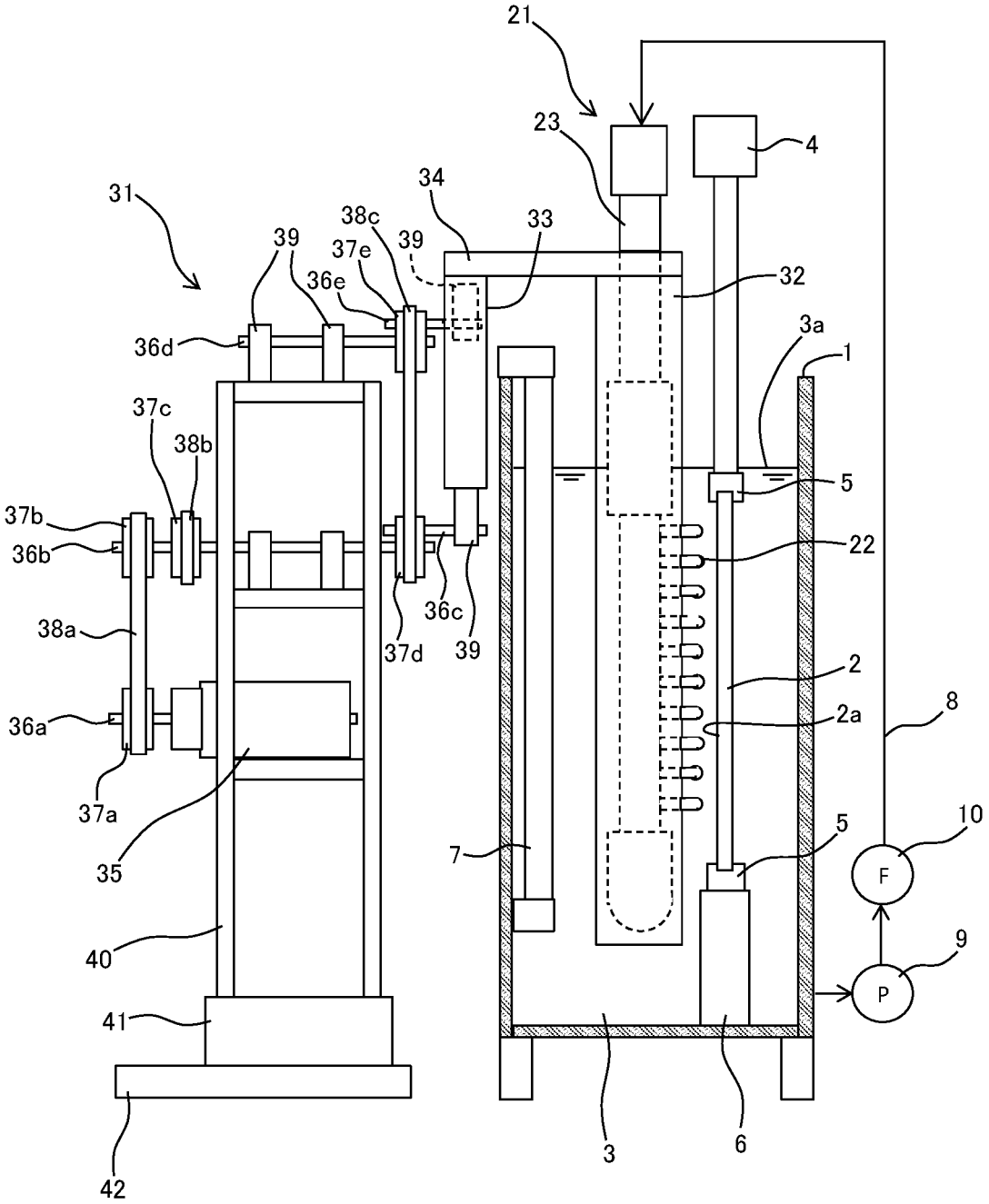

[FIG. 2]
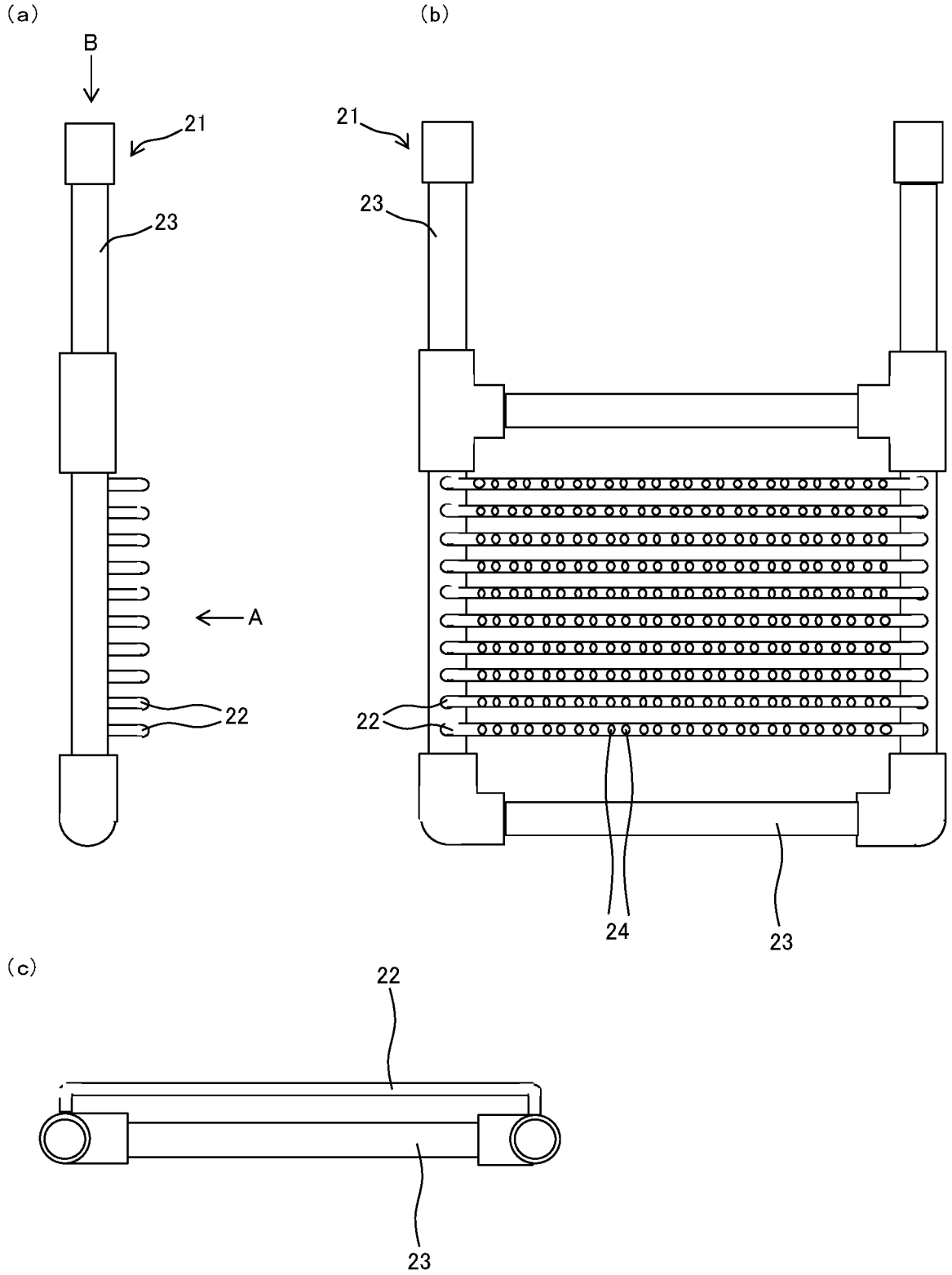

[FIG. 3]
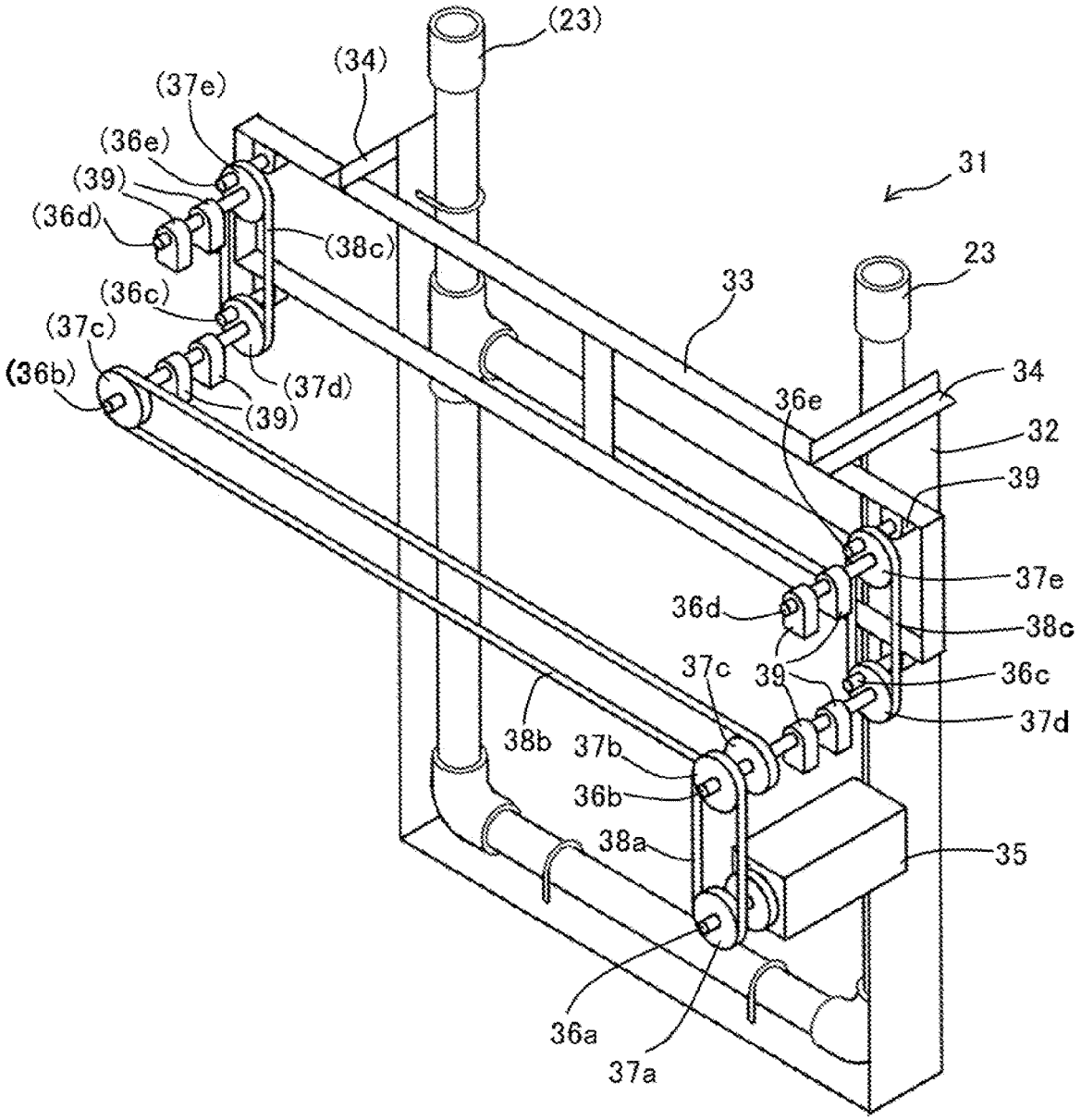

[FIG. 4]
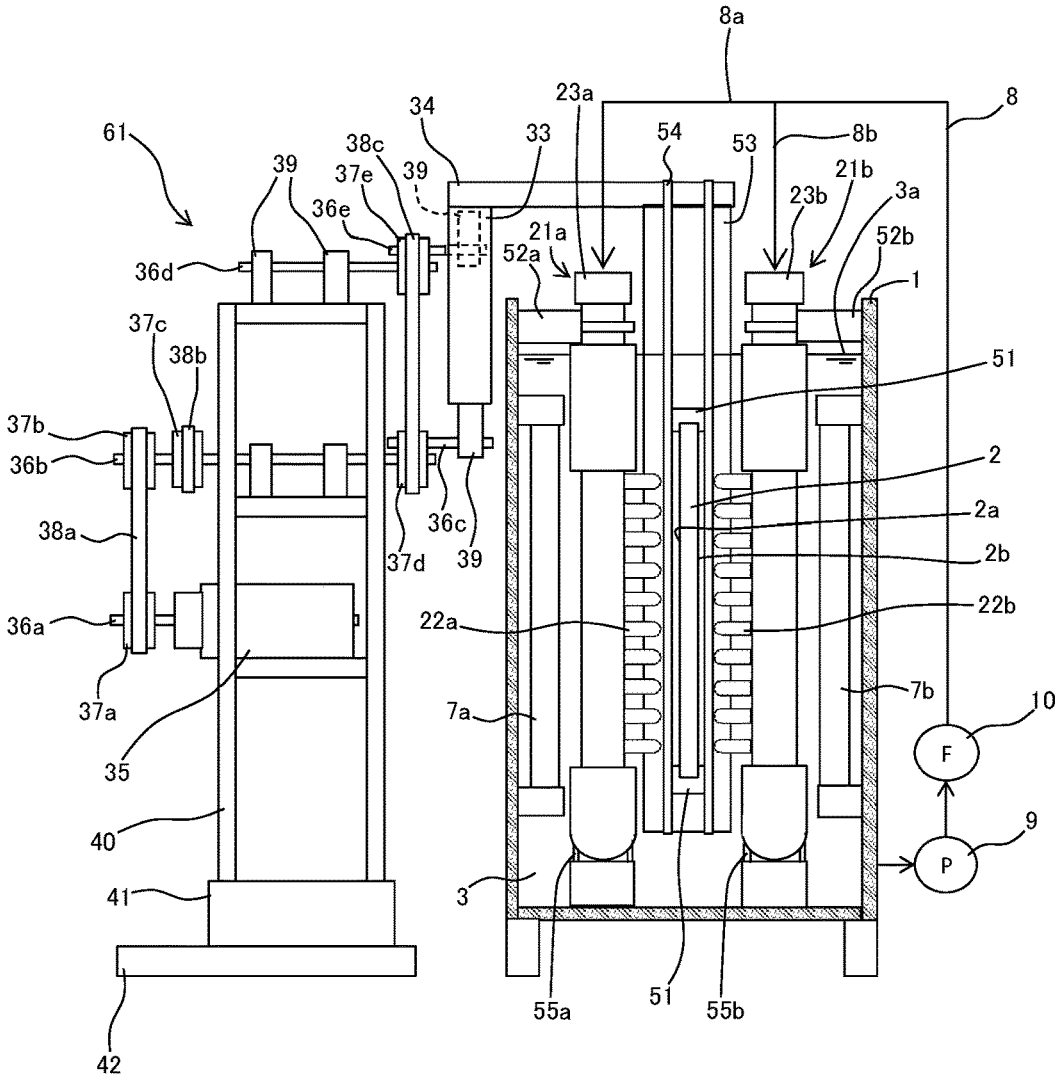
[FIG. 5]
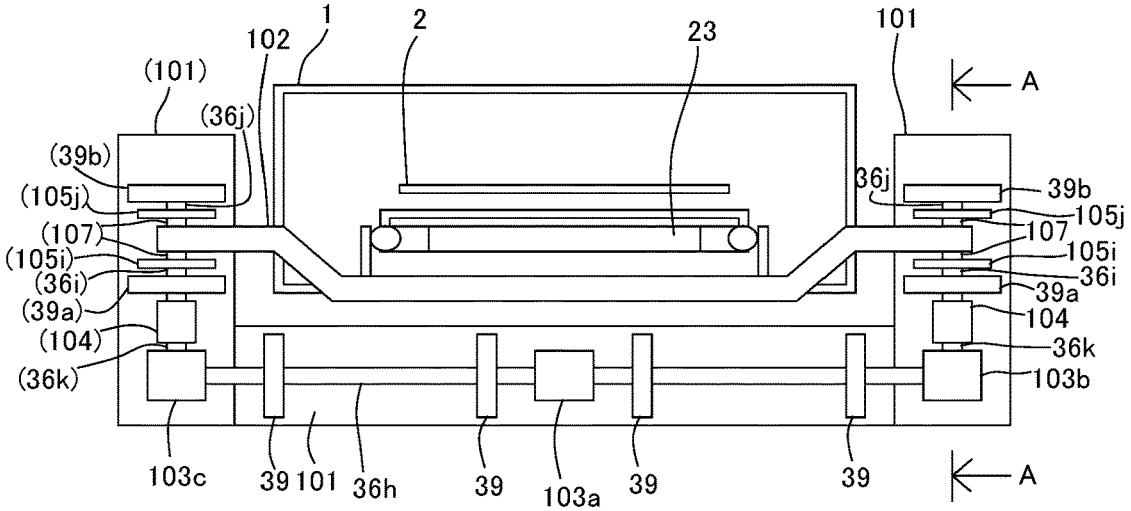

[FIG. 6]
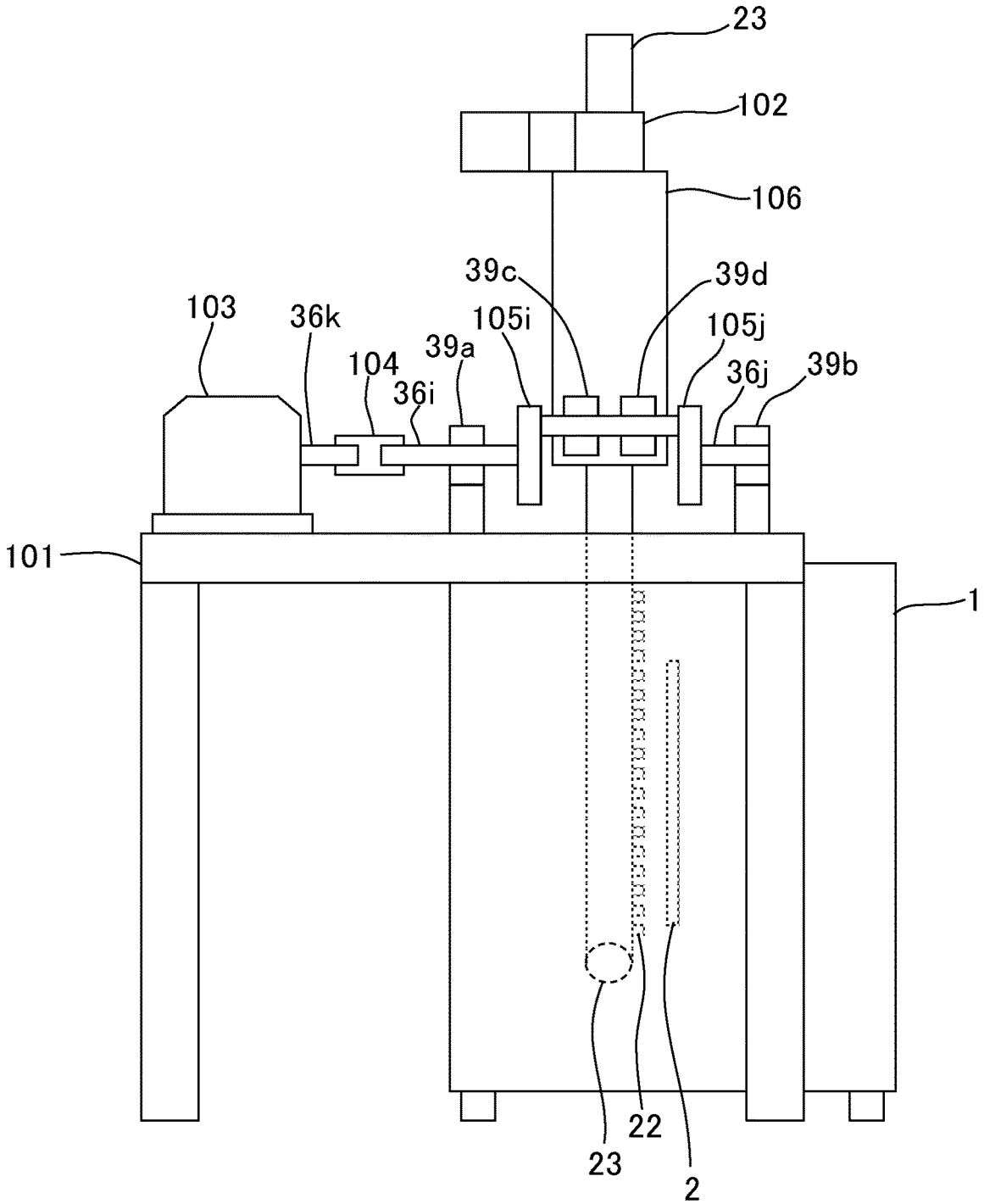

[FIG. 7]
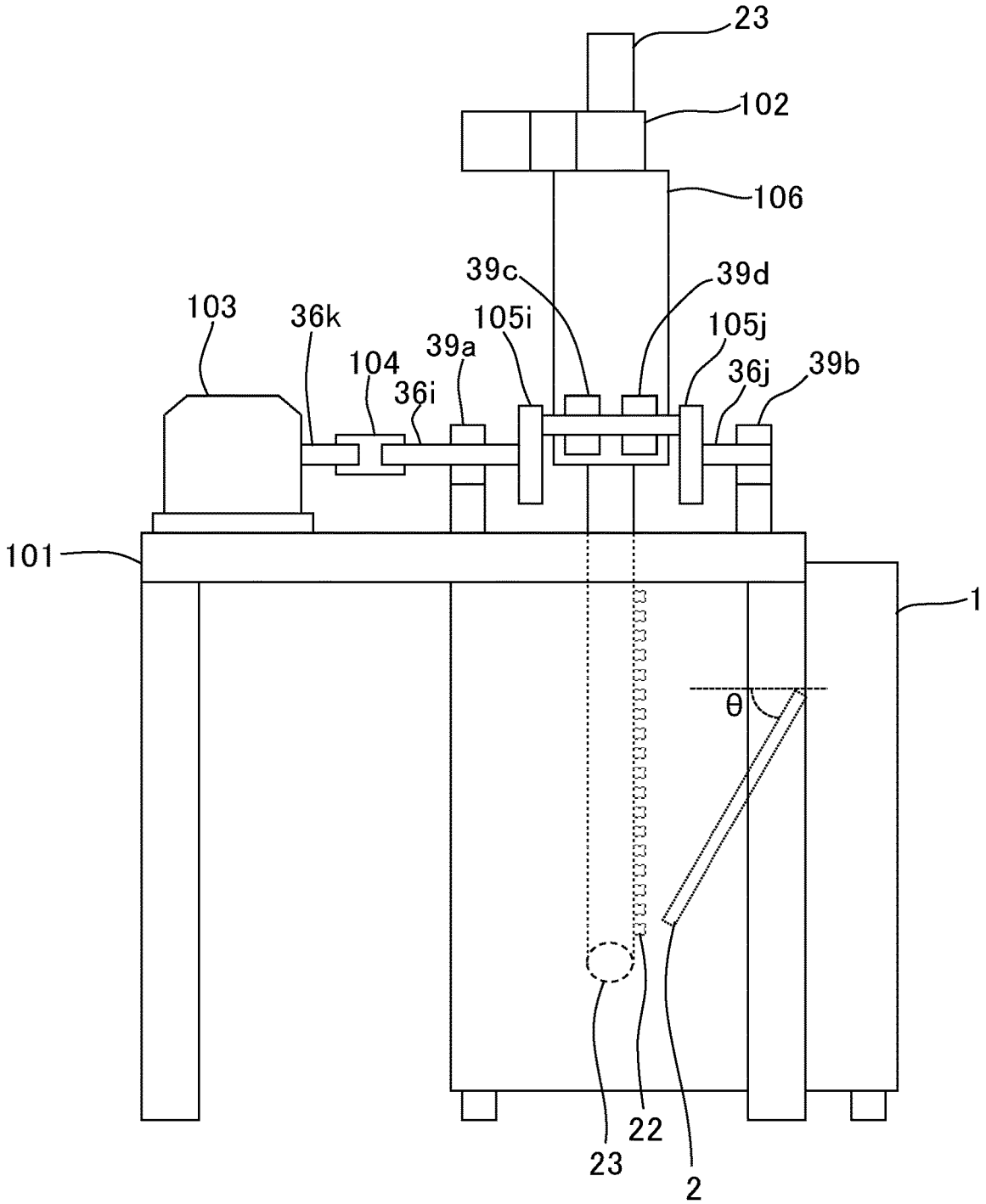

[FIG. 8]
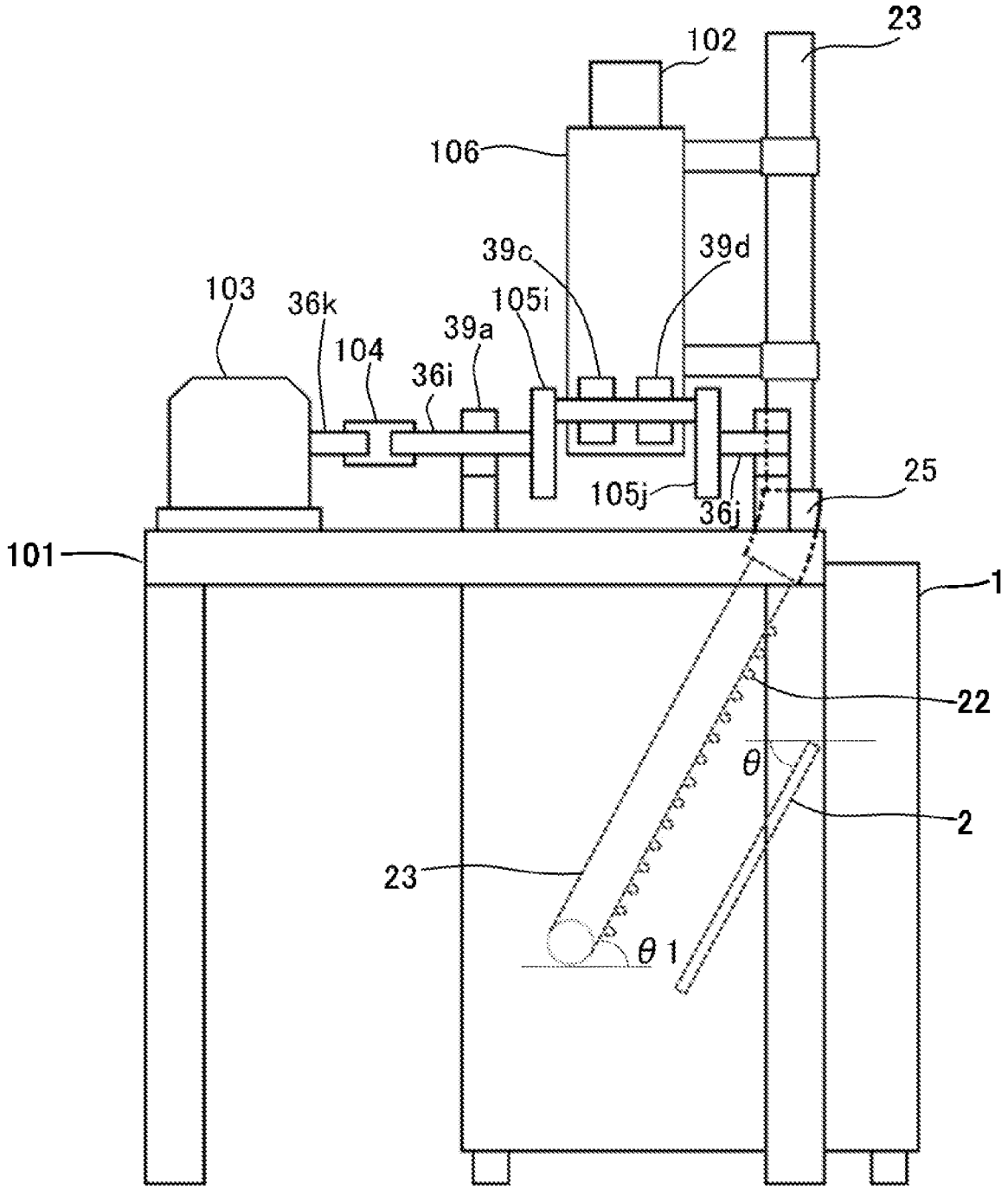

[FIG. 9]
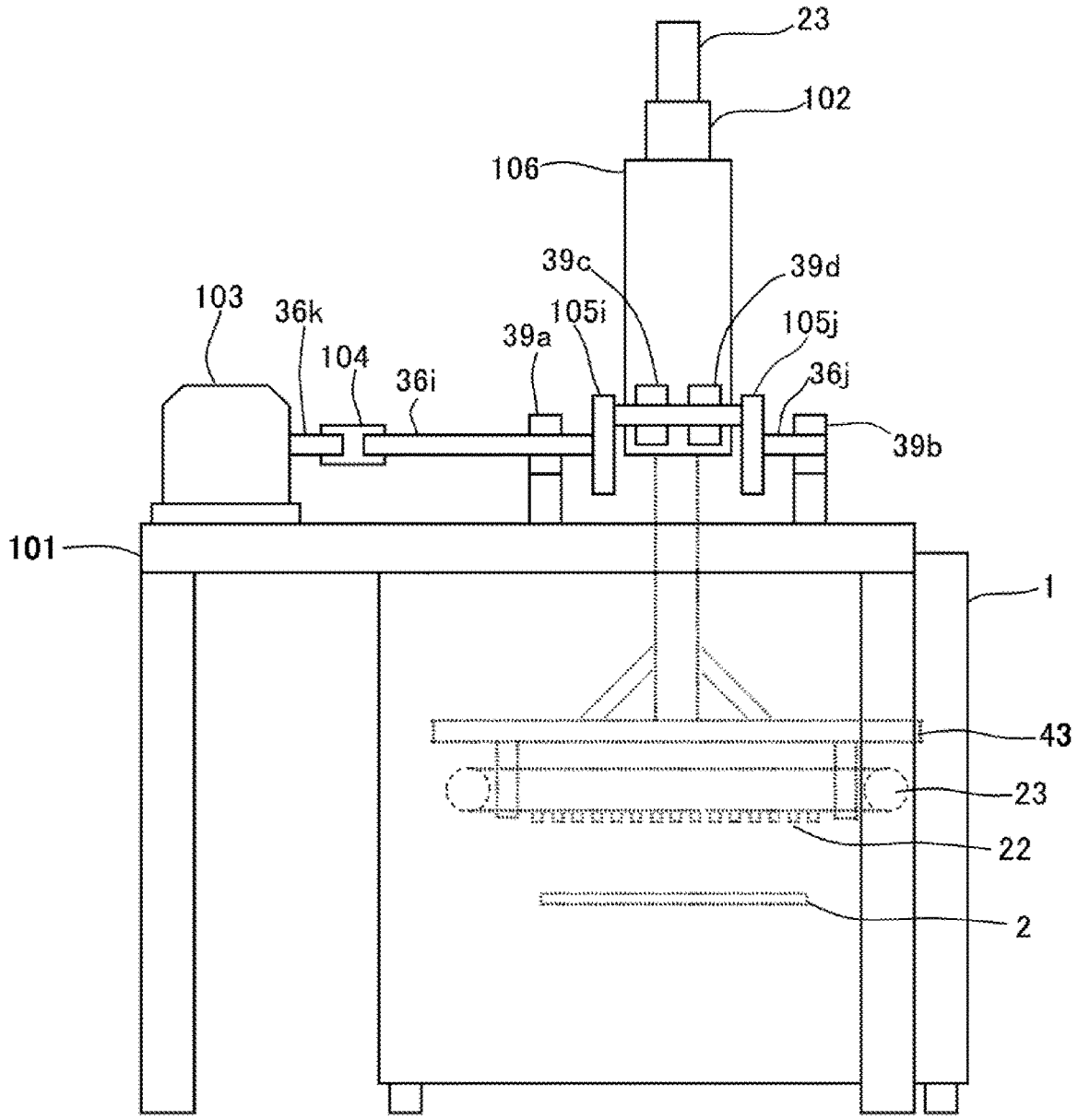

[FIG. 10]
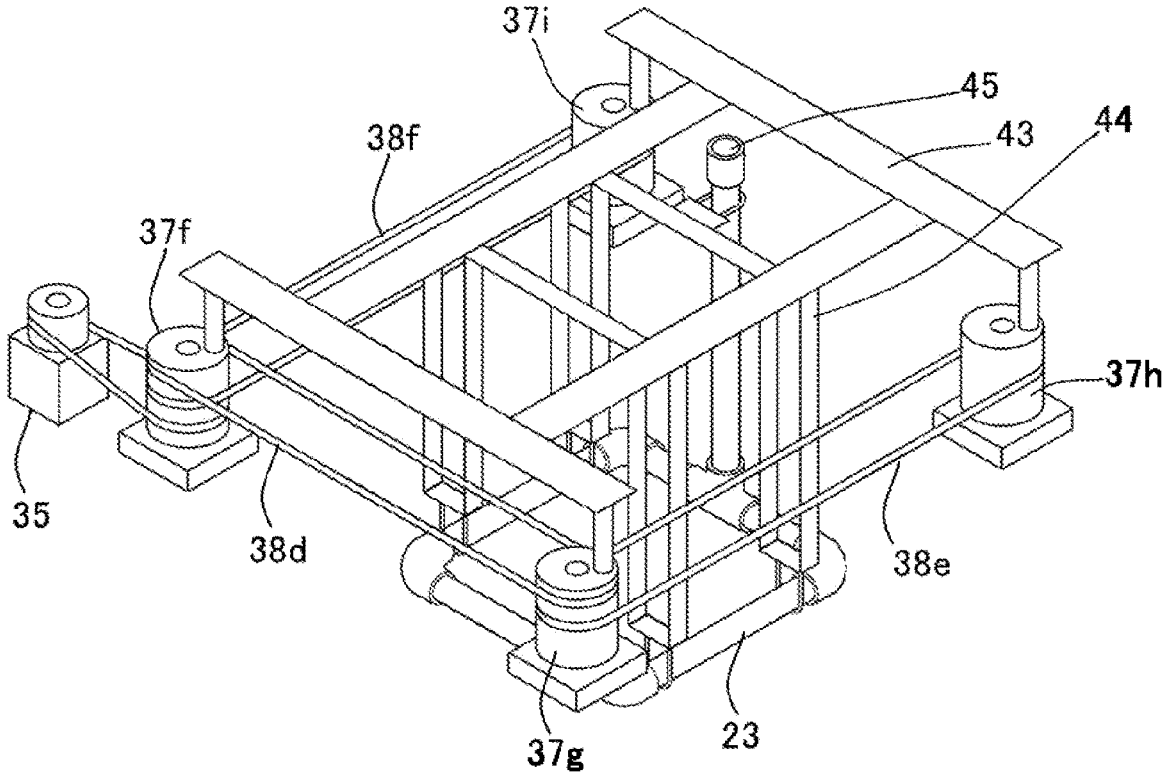

[FIG. 11]
(a)
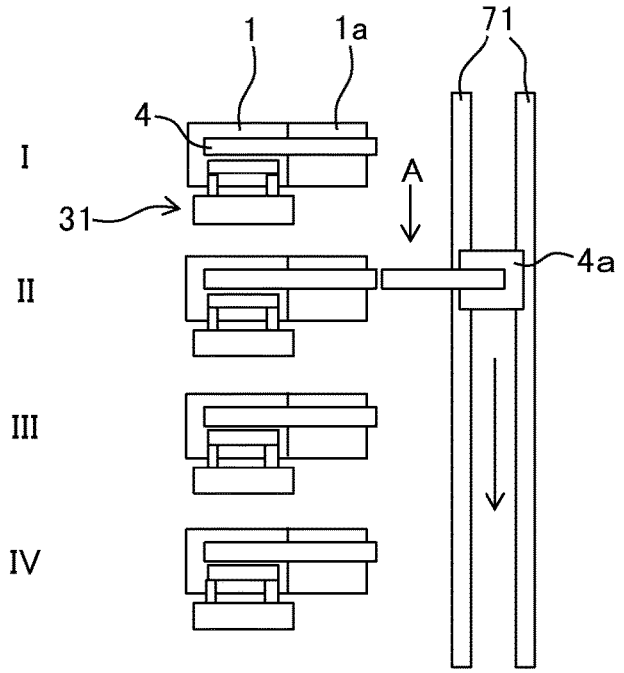
(b)
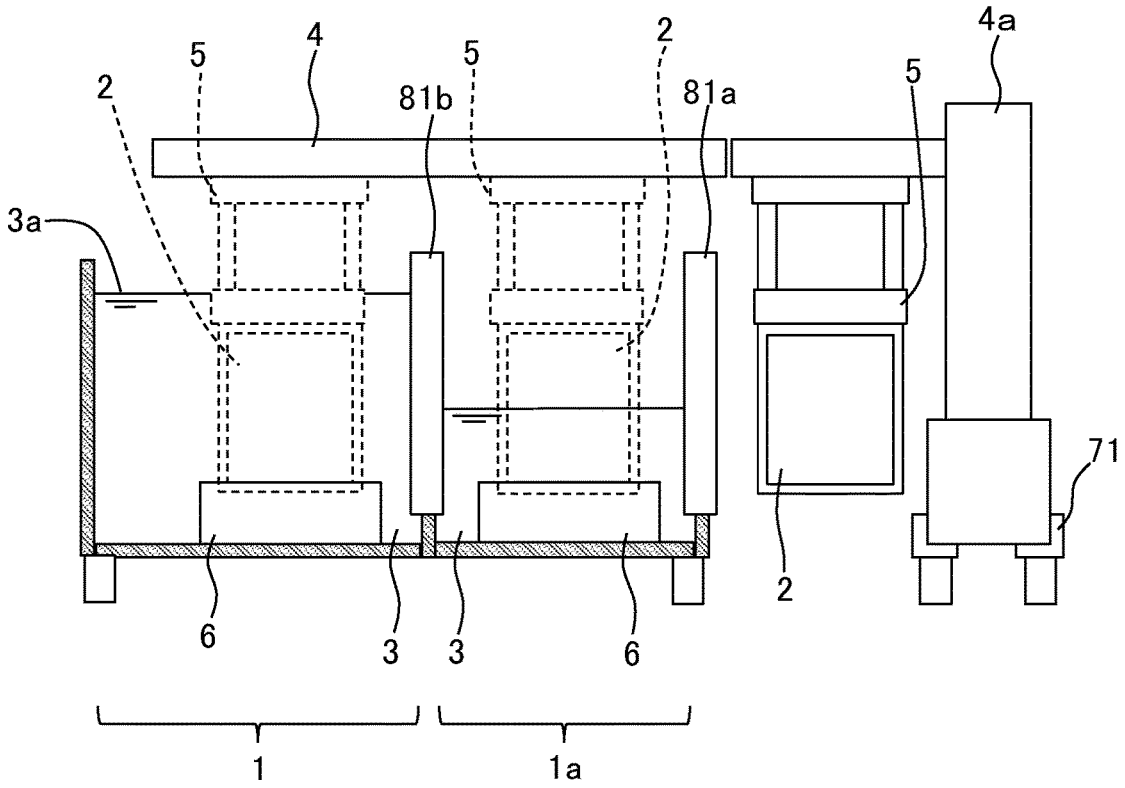

[FIG. 12]
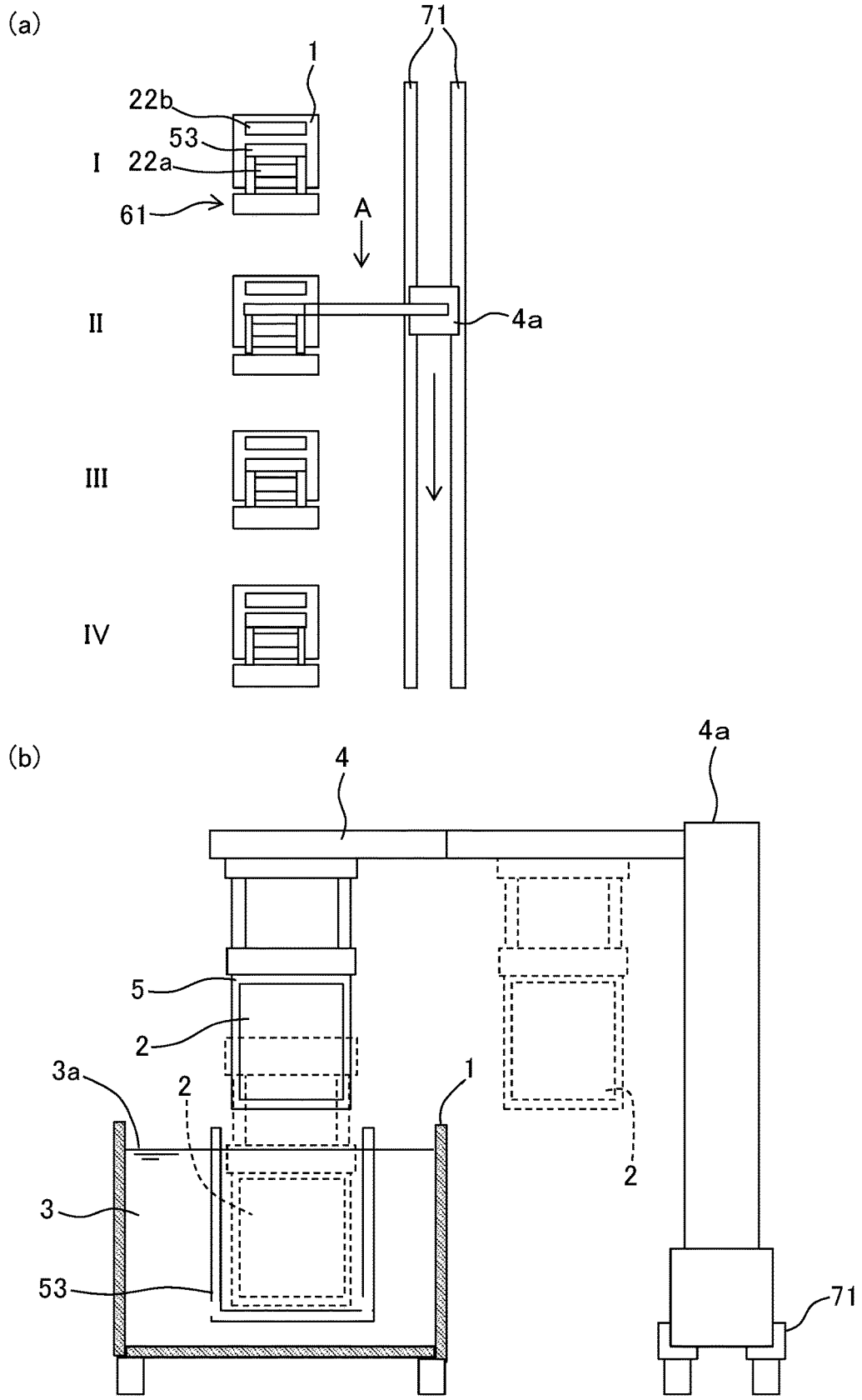

[FIG. 13]
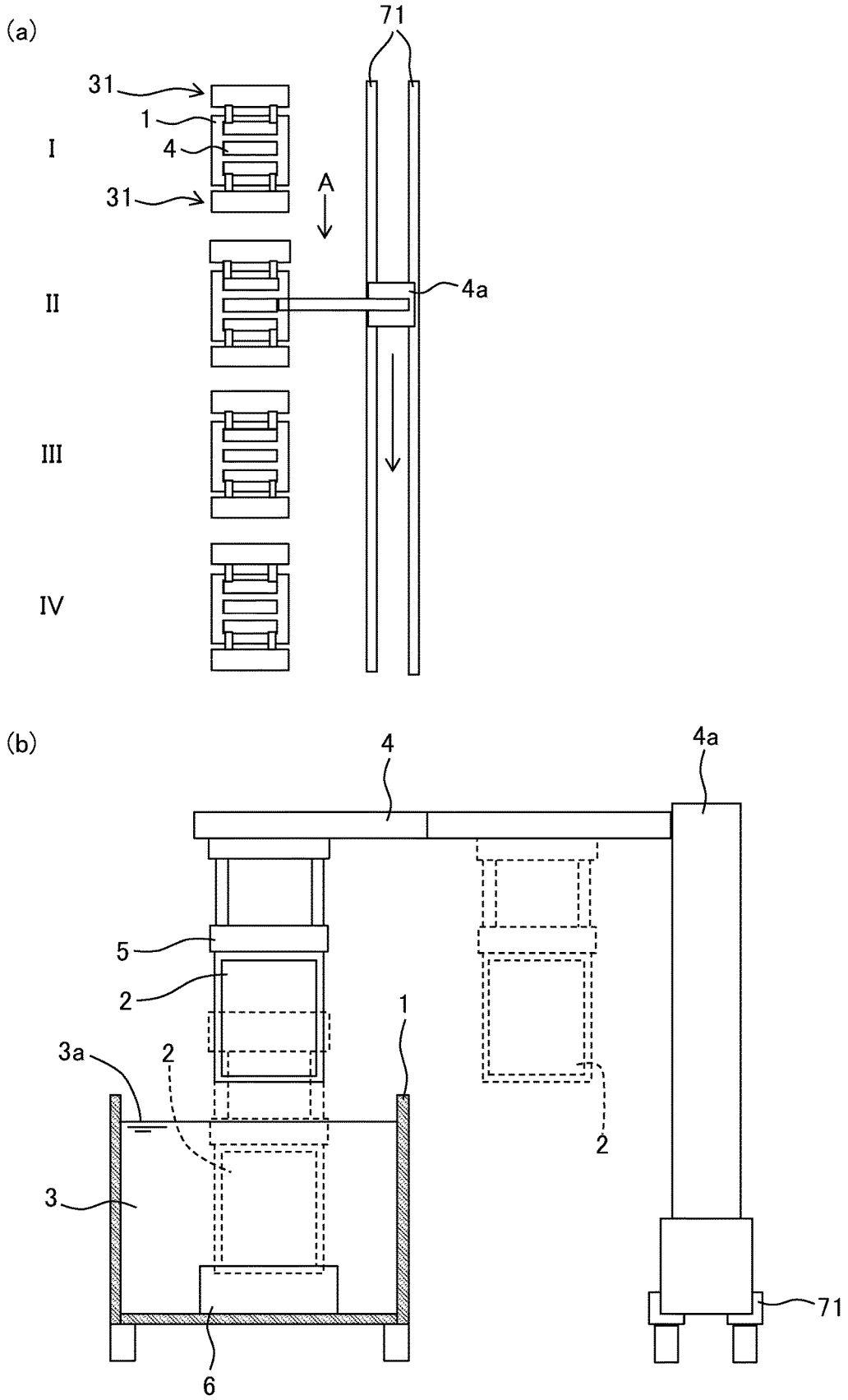

SURFACE TREATMENT APPARATUS AND SURFACE TREATMENT METHOD

TECHNICAL FIELD

The present invention relates to apparatuses and methods for subjecting a workpiece such as a printed board, a semiconductor and a wafer to a surface treatment. The surface treatment includes a coating treatment for subjecting the workpiece to plating and the like; a desmear treatment for removing from the workpiece resin residue and the like that adheres upon machining and the like; a pretreatment and a posttreatment before and after subjecting the workpiece to a predetermined treatment; a cleaning treatment that is performed, as necessary, before and after each treatment; and the like.

BACKGROUND ART

A printed board, a semiconductor, a wafer, and the like are produced by subjecting a workpiece to a coating treatment, such as plating, after performance of an intended machining and the like, and then of a desmear treatment. Before and after each treatment, a pretreatment and a posttreatment are performed, as necessary, and a cleaning treatment may also be performed. Each of these treatments is performed while the workpiece having been inserted into a treatment tank is immersed at least partly or wholly in a solution. The technique in Patent Document 1, for example, is known as technique of subjecting plate work, such as a printed board, to electrolytic plating. The technique in Patent Document 1 has been previously proposed by the present applicant. The Patent Document 1 discloses that a surface treatment apparatus or a plating tank is provided with a spray nozzles to spray a treatment solution towards a workpiece for a purpose of quality improvement of a plating treatment.

PRIOR ART DOCUMENTS

Patent Documents

Patent Document 1: Japanese Unexamined Patent Application Publication No. 2013-11004

SUMMARY OF INVENTION

Technical Problem

The printed board, the semiconductor, the wafer, and the like subjected to various treatments have on their surfaces a via hole (a hole for an interlayer connection), a trench (a recess for wiring), and the like. A diameter of the via hole and width of the trench tend to be decreased for high integration of a semiconductor apparatus. Inversely, a ratio of depth of the via hole to its diameter (depth/diameter of the via hole) and a ratio of depth of the trench to its width (depth/width of the via hole) tend to be increased. This tendency impedes sufficient permeation of the treatment solution and a cleaning solution into the inside of the via hole and the trench even though surfaces of the printed board, the semiconductor, the wafer, and the like are subjected to the treatment. This insufficient permeation results in treatment unevenness in some cases.

The present invention has been accomplished considering the above circumstances, and an object of the present invention is to provide a surface treatment apparatus and a surface treatment method that can improve quality of a surface treatment upon subjecting a workpiece to a surface treatment.

Solutions to Problem

A first surface treatment apparatus according to the present invention that has overcome the above problems is as follows. A surface treatment apparatus for subjecting a workpiece immersed at least partly in a solution to a surface treatment has: a spray nozzle facing the workpiece for spraying a treatment solution towards a working surface of the workpiece. The surface treatment apparatus has at least one of: a spray nozzle rotator to rotate the spray nozzle in a plane parallel to the working surface of the workpiece; or a workpiece rotator to rotate the workpiece in a plane perpendicular to a spraying direction of the treatment solution sprayed from the spray nozzle.

In the first surface treatment apparatus, at least one of the workpiece or the spray nozzle is preferably rotated at an average rotational speed of 100 to 3,000 mm/min. In addition, at least one of the workpiece or the spray nozzle is preferably rotated with an equivalent circle diameter of 20 to 200 mm.

The above problem can also be overcome by a second surface treatment apparatus that is as follows. A surface treatment apparatus for subjecting a workpiece immersed at least partly in a solution to a surface treatment has: a spray nozzle facing the workpiece for spraying a treatment solution towards a working surface of the workpiece; a fixing unit that fix the workpiece with inclination relative to a surface of the solution; and a spray nozzle rotator to rotate the spray nozzle.

The second surface treatment apparatus preferably further has: an inclining unit that incline the spray nozzle in a manner that the working surface of the workpiece and a spraying direction of the treatment solution sprayed from the spray become perpendicular to one another.

The above problem can also be overcome by a third surface treatment apparatus that is as follows. A surface treatment apparatus for subjecting a workpiece immersed at least partly in a solution to a surface treatment has: a spray nozzle facing the workpiece for spraying a treatment solution towards a working surface of the workpiece, and a spray nozzle rotator to rotate the spray nozzle around an axis parallel to the working surface.

In the second and the third surface treatment apparatuses, the spray nozzle is preferably rotated at an average rotational speed of 100 to 3,000 mm/min. In addition, the spray nozzle is preferably rotated with an equivalent circle diameter of 20 to 200 mm.

As to the first to the third surface treatment apparatuses, the spray nozzle preferably sprays the treatment solution at an average flow speed of 1 to 30 m/sec. In addition, the surface treatment apparatuses preferably further has: a treatment tank, a circulation path for a circulation of the treatment solution from the treatment tank of the surface treatment apparatus to the spray nozzle; and a pump on the circulation path for circulating the treatment solution from the treatment tank. In a case where the surface treatment is a plating treatment, and a plating bath temperature is preferably 20 to 50° C. In a case where the surface treatment is an electrolytic plating treatment, and an average current density is preferably 1 to 30 A/dm$^2$. The spray nozzle preferably has a spraying hole having a hole diameter of 1 to 5 mm. An average distance between the spraying holes of the spray nozzle adjacent to one another is preferably 5 to 150 mm. A distance between the spraying hole of the spray nozzle and the workpiece is preferably 10 to 100 mm. A direction of the spray nozzle is such that an angle of the spraying direction of the treatment solution sprayed from the spray nozzle is preferably −70 degrees to +70 degrees when a horizontal direction is defined to be 0 degree.

The gist of a first surface treatment method according to the present invention that has overcome the above problems is as follows. The surface treatment method for subjecting a workpiece immersed at least partly in a solution to a surface treatment includes: spraying a treatment solution towards a working surface of the workpiece from a spray nozzle; and providing the spray nozzle facing the workpiece. The surface treatment method includes at least one of: rotating the spray nozzle in a plane parallel to the working surface of the workpiece; or rotating the workpiece in a plane perpendicular to a spraying direction of the treatment solution sprayed from the spray nozzle.

In the first surface treatment method, at least one of the workpiece or the spray nozzle is preferably rotated at an average rotational speed of 100 to 3,000 mm/min. In addition, at least one of the workpiece or the spray nozzle is preferably rotated with an equivalent circle diameter of 20 to 200 mm.

The above problem can also be overcome by a second surface treatment method that is as follows. The surface treatment method for subjecting a workpiece immersed at least partly in a solution to a surface treatment includes: spraying a treatment solution towards a working surface of the workpiece from a spray nozzle; inclining the workpiece relative to a surface of the solution; and rotating the spray nozzle.

In the second surface treatment method, the spray nozzle is preferably inclined in a manner that the working surface of the workpiece and a spraying direction of the treatment solution sprayed from the spray nozzle become perpendicular to one another.

The above problem can also be overcome by a third surface treatment method that is as follows. The surface treatment method for subjecting a workpiece immersed at least partly in a solution to a surface treatment includes: spraying a treatment solution towards a working surface of the workpiece from a spray nozzle; providing the spray nozzle facing the workpiece; and rotating the spray nozzle around an axis parallel to the working surface.

In the second and the third surface treatment methods, the spray nozzle is preferably rotated at an average rotational speed of 100 to 3,000 mm/min. In addition, the spray nozzle is preferably rotated with an equivalent circle diameter of 20 to 200 mm.

As to the first to the third surface treatment methods, the spray nozzle preferably sprays the treatment solution at an average flow speed of 1 to 30 m/sec. At least two of the workpieces may be prepared and disposed in a treatment tank with the working surfaces of the workpieces facing outwards.

The workpiece may have a recess on its surface. Examples of the workpiece having the recess include a printed board, a semiconductor or a wafer. The surface treatment may be an electrolytic plating treatment or an electroless plating treatment. In a case where the surface treatment is a plating treatment, and a plating bath temperature is preferably 20 to 50° C. In a case where the surface treatment is an electrolytic plating treatment, and an average current density is preferably 1 to 30 A/dm$^2$. An angle of the spraying direction of the treatment solution sprayed from the spray nozzle is preferably −70 degrees to +70 degrees when a horizontal direction is defined to be 0 degree.

Effects of Invention

According to the present invention, upon subjecting the workpiece to the surface treatment, the spray nozzle facing the workpiece sprays the treatment solution towards the workpiece, and at least one of the spray nozzle or the workpiece is rotated. As a result, a direction of the treatment solution sprayed towards a surface of the workpiece varies, thus being able to reduce treatment unevenness and improve quality of the surface treatment.

BRIEF DESCRIPTION OF THE DRAWINGS

FIG. 1 is a schematic view showing an example structure of a first surface treatment apparatus according to the present invention.

FIG. 2 (*a*) is a side view of a spray unit 21 in FIG. 1. FIG. 2 (*b*) shows the spray unit 21 in FIG. 2 (*a*) from the direction A. FIG. 2 (*c*) shows the spray unit 21 in FIG. 2 (*a*) from the direction B.

FIG. 3 is a perspective view showing a connection between a frame 33 and a motor 35.

FIG. 4 is a schematic view showing another example structure of the first surface treatment apparatus according to the present invention.

FIG. 5 is a schematic view showing another example structure of the first surface treatment apparatus according to the present invention.

FIG. 6 is a cross-sectional view showing the first surface treatment apparatus in FIG. 5 from the direction A.

FIG. 7 is a schematic view showing an example structure of a second surface treatment apparatus according to the present invention.

FIG. 8 is a schematic view showing another example structure of the second surface treatment apparatus according to the present invention.

FIG. 9 is a schematic view showing an example structure of a third surface treatment apparatus according to the present invention.

FIG. 10 is a schematic view for describing a spray nozzle rotator to rotate a spray nozzle in a plane parallel to a working surface of a workpiece.

FIG. 11 is a schematic view for describing a procedure for subjecting a workpiece 2 to a surface treatment with the surface treatment apparatus having a spray nozzle rotator 31 in FIG. 1.

FIG. 12 is a schematic view for describing a procedure for subjecting a workpiece 2 to a surface treatment with the surface treatment apparatus having a workpiece rotator 61 in FIG. 4.

FIG. 13 is a schematic view for describing another procedure for subjecting a workpiece 2 to a surface treatment with the surface treatment apparatus having the spray nozzle rotator 31 in FIG. 1.

DETAILED DESCRIPTION OF THE INVENTION

All first to third surface treatment methods of the present invention are for subjecting a workpiece immersed at least partly in a solution to a surface treatment. These are in common with one another from a perspective of spraying a treatment solution towards a working surface of the workpiece from a spray nozzle.

A first surface treatment method according to the present invention includes: spraying a treatment solution towards a working surface of a workpiece from a spray nozzle; and providing the spray nozzle facing the workpiece. The first surface treatment method includes at least one of: rotating the spray nozzle in a plane parallel to the working surface of the workpiece; or rotating the workpiece in a plane perpendicular to a spraying direction of the treatment solution sprayed from the spray nozzle. Rotating the spray nozzle or the workpiece brings variations to places with which the treatment solution sprayed from the spray nozzle comes into contact and to directions from which the treatment solution makes such contact. This leads to contact of the treatment solution with the workpiece from various directions. As a result, the treatment solution comes into even contact with a surface of the workpiece, thus being able to reduce treatment unevenness and improve quality of a surface treatment.

A second surface treatment method according to the present invention includes: spraying a treatment solution towards a working surface of a workpiece from a spray nozzle; inclining the workpiece relative to a surface of a solution; and rotating the spray nozzle. Rotating the spray nozzle brings variations to places with which the treatment solution sprayed from the spray nozzle comes into contact and to directions from which the treatment solution makes such contact. This leads to contact of the treatment solution with the workpiece from various directions. In addition, inclining the workpiece relative to the surface of the solution easily removes and discharges bubbles adhering to a surface of the workpiece, and to the inside of a recess and a through hole that are formed on the surface of the workpiece. As a result, the treatment solution comes into even contact with the surface of the workpiece, thus being able to reduce treatment unevenness and improve quality of a surface treatment.

In the second surface treatment method, the spray nozzle is preferably inclined in a manner that the working surface of the workpiece and a spraying direction of the treatment solution sprayed from the spray nozzle become perpendicular to one another. Equalizing an inclination angle of the working surface of the workpiece relative to the surface of the solution with an inclination angle of the spray nozzle relative to the surface of the solution enables even contact of the treatment solution with the surface of the workpiece, thus being able to reduce treatment unevenness and further improve quality of the surface treatment.

A third surface treatment method according to the present invention includes: spraying a treatment solution towards a working surface of a workpiece from a spray nozzle; providing the spray nozzle facing the workpiece; and rotating the spray nozzle around an axis parallel to the working surface. Providing the spray nozzle facing the workpiece and rotating the spray nozzle around the axis parallel to the working surface bring variations to places with which the treatment solution sprayed from the spray nozzle comes into contact and to directions from which the treatment solution makes such contact. This leads to contact of the treatment solution with the workpiece from various directions. As a result, the treatment solution comes into even contact with a surface of the workpiece, thus being able to reduce treatment unevenness and improve quality of a surface treatment.

As described above, the first surface treatment method rotates at least one of the spray nozzle or the workpiece, whereas the second and the third surface treatment methods rotate the spray nozzle. Such rotation can improve quality of the surface treatment. Hereinafter are described in detail the first to the third surface treatment methods.

In the surface treatment method according to the present invention, the workpiece is immersed at least partly in the solution, and towards this workpiece is sprayed the treatment solution from the spray nozzle.

Composition of the solution in which the workpiece is immersed and of the treatment solution sprayed from the spray nozzle may be the same or different.

The workpiece may be immersed at least partly or wholly in the solution in a treatment tank. In addition, the workpiece may periodically or randomly repeat a state of being immersed partly or wholly in the solution in the treatment tank.

The spray nozzle is provided to face the working surface of the workpiece and has, at a tip thereof, a spraying hole that sprays the treatment solution. Details of the spraying hole will be described later.

The first surface treatment method rotates at least one of the spray nozzle or the workpiece, whereas the second and the third surface treatment methods rotate the spray nozzle.

A rotational direction of the workpiece or the spray nozzle may be a clockwise direction (a forward direction) or a counterclockwise direction (a backward direction), but is not particularly limited thereto. The clockwise direction and the counterclockwise direction may be repeated periodically or randomly.

Preferable rotational conditions of the workpiece or the spray nozzle are as follows, but not particularly limited thereto.

[Average Rotational Speed]

The workpiece or the spray nozzle is preferably rotated at an average rotational speed of 100 to 3,000 mm/min. An average rotational speed of less than 100 mm/min fails to sufficiently yield a quality improvement effect of the surface treatment from the rotation. The average rotational speed is more preferably 150 mm/min or more and further preferably 200 mm/min or more. However, an average rotational speed of more than 3,000 mm/min causes the solution in the treatment tank to be stirred to an excessive degree that leads to excessively high flow speed of the treatment solution on the workpiece. This excessively high flow speed impedes a reaction of the surface treatment, thus rather deteriorating quality of the surface treatment in some cases. The average rotational speed is more preferably 2,500 mm/min or less, further preferably 2,000 mm/min or less, especially preferably 1,500 mm/min or less, and most preferably 1,000 mm/min or less.

Rotational speed of the workpiece or the spray nozzle may be suitably adjusted to a degree that its average rotational speed satisfies the above range. For example, the rotational speed may be relatively increased at an initial stage of the surface treatment, and then relatively decreased at its later stage. Increasing the rotational speed at an initial stage of the surface treatment allows the treatment solution to reach the depths of a via hole and a trench, and decreasing the rotational speed allows the treatment solution to come into contact with front sides of the via hole and the trench. This enables performance of the surface treatment with evenness. Also, the rotational speed may be increased at an initial stage of the surface treatment, and then may be being decreased with a lapse of time. Alternatively, the rotational speed may be relatively decreased at an initial stage of the surface treatment, and then relatively increased at its later stage. Decreasing the rotational speed at an initial stage of the surface treatment enables gradual progress of a treatment on the workpiece, thus achieving favorable surface texture.

Preferably, the rotational speed of the workpiece or the spray nozzle is relatively increased initially, and then relatively decreased later from a perspective of improving quality of the surface treatment.

The initial stage of the surface treatment refers to a period that corresponds to at least ⅓ of whole treatment time during which the treatment solution is sprayed towards the workpiece. The later stage of the surface treatment refers to a period that corresponds to at least ⅓ of the whole treatment time during which the treatment solution is sprayed towards the workpiece (the same shall apply hereafter).

[Equivalent Circle Diameter]

An extent to which the workpiece or the spray nozzle is rotated is preferably 20 to 200 mm in equivalent circle diameter (10 to 100 mm in rotation radius). An equivalent circle diameter of less than 20 mm fails to sufficiently yield a quality improvement effect of the surface treatment from the rotation. The equivalent circle diameter is more preferably 30 mm or more and further preferably 40 mm or more. However, an equivalent circle diameter of more than 200 mm saturates a quality improvement effect of the surface treatment from the rotation. The equivalent circle diameter is more preferably 150 mm or less and further preferably 100 mm or less.

[Rotational Path]

Examples of a rotational path in which the workpiece or the spray nozzle is rotated includes a perfect circular path, an oval path, a triangular path, a square path and a polygonal path, but are not particularly limited thereto. The path may be a combination of two or more of these. For example, the rotation may track a path like a figure of eight.

In the first surface treatment method, just at least one of the workpiece or the spray nozzle may be rotated, or both of them may be rotated. Rotating both of the workpiece and the spray nozzle makes the treatment solution easily come into contact with the working surface of the workpiece, thus optimizing the surface treatment and improving quality of the surface treatment. Upon rotating both of the workpiece and the spray nozzle, both may be rotated in the same direction, or one of them may be rotated in a clockwise direction, and the other in a counterclockwise direction.

As to conditions for rotating both of the workpiece and the spray nozzle, an average rotational speed, an equivalent circle diameter, a rotational path, and the like may be suitably adjusted within the above range with regard to the respective workpiece and spray nozzle.

In the first surface treatment method, the workpiece or the spray nozzle may be oscillated with concurrent rotation. For example, in rotating the workpiece, this rotating workpiece may be oscillated in a reciprocating movement. An oscillation direction is, for example, a horizontal direction, a vertical direction, or the like relative to a surface of the solution, and thus the reciprocating movement may be in linear motion.

In the first surface treatment method, one of the workpiece or the spray nozzle is rotated, and the other may be oscillated. For example, while the workpiece is rotated, the spray nozzle may be oscillated in a reciprocating movement in a horizontal direction. An oscillation direction is, for example, a horizontal direction, a vertical direction, or the like relative to the surface of the solution, and thus the reciprocating movement may be in linear motion.

In the second and the third surface treatment methods, the spray nozzle may be oscillated with concurrent rotation. For example, in rotating the spray nozzle, this rotating spray nozzle may be oscillated in a reciprocating movement. An oscillation direction is, for example, a horizontal direction, a vertical direction, or the like relative to a surface of the solution, and thus the reciprocating movement may be in linear motion.

Preferable oscillation conditions for the workpiece or the spray nozzle are as follows, but not particularly limited thereto.

[Movement Distance of Workpiece or Spray Nozzle]

A one-way movement distance within which the workpiece or the spray nozzle is oscillated in the reciprocating movement is preferably 5 to 500 mm, for example. Whichever this distance becomes excessively small or large, such a distance deteriorates efficiency of the treatment solution to come into contact with the workpiece, thus being unlikely to yield a quality improvement effect of the surface treatment from the oscillation. The movement distance is more preferably 10 mm or more and further preferably 30 mm or more, and more preferably 450 mm or less and further preferably 400 mm or less.

[Required Time for One Reciprocation]

Upon the oscillation, required time for one reciprocation is preferably 1 to 600 seconds, for example. When this time is excessively short, it causes the workpiece or the spray nozzle to vibrate. This vibration impedes progress of a reaction on the workpiece, thus being unlikely to yield a quality improvement effect of the surface treatment from the oscillation. Inversely, when this time is excessively long, the workpiece or the spray nozzle is hardly oscillated. Such absence of the oscillation deteriorates efficiency of the treatment solution to come into contact with the workpiece, thus being unlikely to yield a quality improvement effect of the surface treatment. The required time for one reciprocation is more preferably 30 seconds or longer and further preferably 60 seconds or longer, and more preferably 550 seconds or shorter and further preferably 500 seconds or shorter.

In the first to the third surface treatment methods, the spray nozzle sprays the treatment solution towards the working surface of the workpiece. A preferable range of an average flow speed of the treatment solution sprayed from the spray nozzle is as follows.

[Average Flow Speed of Treatment Solution]

The average flow speed of the treatment solution sprayed from the spray nozzle is preferably 1 to 30 m/sec. An average flow speed of less than 1 m/sec fails to sufficiently yield a quality improvement effect of the surface treatment from spraying the treatment solution. The average flow speed is more preferably 3 m/sec or more and further preferably 5 m/sec or more. However, an average flow speed of more than 30 m/sec causes damage to a surface of the workpiece, thus rather deteriorating quality of the surface treatment in some cases. The average flow speed is more preferably 25 m/sec or less and further preferably 20 m/sec or less.

Flow speed of the treatment solution may be suitably adjusted to a degree that its average flow speed satisfies the above range. For example, the flow speed may be relatively increased at the initial stage of the surface treatment, and then relatively decreased at its later stage. Increasing the flow speed of the treatment solution at the initial stage of the surface treatment allows the treatment solution to reach the depths of a via hole and a trench, and decreasing the flow speed of the treatment solution allows the treatment solution to come into contact with front sides of the via hole and the trench. This enables performance of the surface treatment with evenness. Also, the flow speed of the treatment solution may be increased at the initial stage, and then may be being decreased with a lapse of time. Alternatively, the flow speed of the treatment solution may be relatively decreased at the initial stage of the surface treatment, and then relatively increased at its later stage. Decreasing the flow speed of the treatment solution at the initial stage of the surface treatment enables gradual progress of a treatment on the workpiece, thus achieving favorable surface texture. Preferably, the flow speed of the treatment solution is relatively increased initially, and then relatively decreased later from a perspective of improving quality of the surface treatment.

The treatment solution may be sprayed continuously or intermittently from the spray nozzle. Sprayed intermittently, the treatment solution increasingly comes into contact with the surface of the workpiece. This increased contact optimizes the surface treatment. Upon being intermittently sprayed, the treatment solution may be sprayed periodically or randomly.

Upon subjecting a plurality of workpieces to the surface treatment by the surface treatment method of the present invention, the workpieces are preferably disposed in the treatment tank with back surfaces of the workpieces facing inwards and thus their working surfaces facing outwards. That is, at least two of the workpieces are prepared and disposed in the treatment tank with the working surfaces of the workpieces facing outwards, and then the surface treatment may be performed.

Surface texture of the working surface is not limited. The working surface may have a flat surface or have a recess on its surface. In the present invention, the spray nozzle or the workpiece is rotated, and this rotation allows the treatment solution to permeate into the depths of the recess even on the surface of the workpiece. This enables performance of the surface treatment without unevenness.

The recess refers to an opening formed on a surface of a working part, and examples of the recess include a via hole and a trench. The via hole may be a through hole penetrating in a thickness direction of a workpiece or be a non-through hole. Examples of the workpiece having the recess include a printed board, a semiconductor and a wafer. Examples of the wafer include a wafer level chip size package and a fan out wafer level package.

The surface treatment includes a coating treatment for subjecting the workpiece to plating and the like; a desmear treatment for removing from the workpiece resin residue and the like that adheres upon machining and the like; a pretreatment and a posttreatment before and after subjecting the workpiece to a predetermined treatment; a cleaning treatment that is performed, as necessary, before and after each treatment; and the like. An example of the coating treatment includes a plating treatment, and, specifically, the coating treatment may be an electrolytic plating treatment or an electroless plating treatment.

Preferable conditions for the plating treatment are as follows.

[Plating Bath Temperature]

A plating bath temperature of the plating treatment is preferably 20 to 50° C., for example. Excessively low plating bath temperature impedes progress of the plating treatment. Inversely, excessively high plating bath temperature is likely to cause plating unevenness, thus rather deteriorating quality of the surface treatment. The plating bath temperature is more preferably 23° C. or higher and further preferably 25° C. or higher, and more preferably 45° C. or lower and further preferably 40° C. or lower.

[Average Current Density of Electrolytic Plating Treatment]

An average current density of the electrolytic plating treatment is preferably 1 to 30 A/dm$^2$, for example. Excessively low average current density impedes progress of the electrolytic plating treatment. Inversely, excessively high average current density is likely to cause electrolytic plating unevenness, thus rather deteriorating quality of the surface treatment. The average current density is more preferably 3 A/dm$^2$ or more and further preferably 5 A/dm$^2$ or more, and more preferably 25 A/dm$^2$ or less and further preferably 20 A/dm$^2$ or less.

[Treatment Time of Electrolytic Plating Treatment]

Treatment time of the electrolytic plating treatment is preferably adjusted according to required plating film thickness.

Next, surface treatment apparatuses according to the present invention are described. A first surface treatment apparatus of the present invention is for subjecting a workpiece immersed at least partly in a solution to a surface treatment, and has a spray nozzle facing the workpiece for spraying a treatment solution towards a working surface of the workpiece. In addition, the first surface treatment apparatus has at least one of a spray nozzle rotator to rotate the spray nozzle in a plane parallel to the working surface of the workpiece, or a workpiece rotator to rotate the workpiece in a plane perpendicular to a spraying direction of the treatment solution sprayed from the spray nozzle.

A specific aspect of the first surface treatment apparatus of the present invention is described with the drawings. Hereinafter is described the first surface treatment apparatus for subjecting a printed board to an electrolytic plating treatment, but the first surface treatment apparatus of the present invention is not limited thereto.

FIG. 1 is a schematic view showing an example structure of the first surface treatment apparatus according to the present invention. The first surface treatment apparatus has the spray nozzle rotator to rotate the spray nozzle in the plane parallel to the working surface of the workpiece. In FIG. 1, a treatment tank 1 is filled with a solution 3, and in the solution 3 is wholly immersed a workpiece 2. A surface of the treatment solution is represented by 3*a*. A transfer unit 4 is for transferring the workpiece 2 from and to the treatment tank 1. In FIG. 1, the workpiece 2 is held by the transfer unit 4 via a jig 5. The jig 5 is held by a jig guide 6. In a vicinity of a wall of the treatment tank 1 is provided an anode 7.

A spray unit 21 is for spraying the treatment solution, and the treatment solution is sprayed towards a working surface 2*a* of the workpiece 2. The spray unit 21 is provided with a spray nozzle 22, and the spray nozzle 22 faces the working surface 2*a* of the workpiece 2. The spray nozzle 22 may be hereinafter referred to as a sparger. The spray nozzle 22 communicates with a sparger pipe 23. The spray unit 21 is described in more detail with FIG. 2.

FIG. 2 (*a*) is a side view of the spray unit 21 that is the same as that in FIG. 1. FIG. 2 (*b*) shows the spray unit 21 in FIG. 2 (*a*) from the direction A, and FIG. 2 (*c*) shows the spray unit 21 in FIG. 2 (*a*) from the direction B. The spray nozzle 22 has a plurality of spraying holes 24, and these spraying holes 24 face the working surface 2*a* of the workpiece 2.

[Distance between Spraying Hole and Working Surface of Workpiece]

A distance between the spraying hole 24 and the working surface 2*a* of the workpiece 2 is preferably 10 to 100 mm, for example. When this distance is excessively small, a surface of a workpiece may be damaged by force of the treatment solution. When this distance is excessively large, such distance necessitates an increase in flow speed at which the treatment solution is sprayed from the spray nozzle. This causes an increased facility load. The distance is more preferably 15 mm or more and further preferably 20 mm or more, and more preferably 90 mm or less and further preferably 80 mm or less.

FIG. 2 shows an example structure provided with ten spray nozzles 22, but the number of the spray nozzle 22 is not limited, and may be determined based upon a type of the surface treatment method, a condition for the surface treatment, a scale of the first surface treatment apparatus, and the like.

The number of the spraying hole 24 in FIG. 2 (*b*) is also not limited, and the spraying hole 24 may be provided based upon a type of the surface treatment method, a condition for the surface treatment, a scale of the first surface treatment apparatus (especially the spray nozzle 22), and the like.

Now, return to FIG. 1, and a description continues. A circulation path 8 is for a circulation of the solution 3, and, in this path, the solution 3 is circulated from the treatment tank 1 to the spray nozzle 22 through the sparger pipe 23 provided to the spray unit 21. On the circulation path 8 are provided a pump 9 for circulating the solution 3 from the treatment tank 1, and a filter 10 for removing a solid contained in the solution 3. Circulating the solution 3 from the circulation path 8 to the spray unit 21 enables the spray nozzle 22 to spray the solution 3, as the treatment solution, towards the working surface 2*a* of the workpiece 2. Although the circulation path 8 is provided in an example structure in FIG. 1, the circulation path 8 may not be provided. In this case, the treatment solution is preferably supplied from an unillustrated path to the spray unit 21, and a surplus of the solution 3 in the treatment tank 1 is preferably discharged through an unillustrated path.

The spray unit 21 is attached to the spray nozzle rotator 31, and the spray nozzle 22 is configured to rotate in a plane parallel to the working surface 2*a* of the workpiece 2. That is, the spray unit 21 is held by a pipe support 32, and the pipe support 32 is connected with a frame 33 via a bracket 34.

FIG. 3 is a perspective view showing a connection between the frame 33 and a motor 35. FIG. 3 does not illustrate a part of FIG. 1 for convenience of a description. In FIG. 3, reference signs without parentheses and ones with parentheses represent the same components.

As shown in FIG. 3, the frame 33 is connected with the motor 35 via a shaft 36*a* to 36*e*, a timing pulley 37*a* to 37*e* and a timing belt 38*a* to 38*c*.

As shown in FIGS. 1 and 3, torque of the motor 35 is transmitted to the frame 33 via a shaft, a timing pulley and a timing belt, and this transmitted torque rotates the spray nozzle 22 in the plane parallel to the working surface 2*a* of the workpiece 2. In FIG. 1, a frame 40 for holding a bearing 39, the motor 35 and the like; a mobile base 41 for moving the frame 40; and a rail 42 for moving the mobile base 41 are respectively provided.

Oscillating the mobile base 41 in a crosswise direction relative to a paper surface can bring variations to a distance between the spray nozzle 22 and the working surface 2*a* of the workpiece 2. Bringing variations to the distance between the spray nozzle 22 and the working surface 2*a* of the workpiece 2 makes the treatment solution easily come into even contact with a surface of a workpiece, thus improving quality of a surface treatment.

[Variation Range]

A variation range of the distance between the spray nozzle 22 and the working surface 2*a* is preferably 10 to 100 mm, for example, but not particularly limited thereto. Whichever this variation range is excessively narrow or wide, such a variation range is unlikely to yield a quality improvement effect of the surface treatment from a movement of a workpiece. The variation range is more preferably 20 mm or more and further preferably 30 mm or more, and more preferably 90 mm or less and further preferably 80 mm or less.

A condition for varying the distance between the spray nozzle 22 and the working surface 2*a* is not limited, and the distance may be shortened at the initial stage of a surface treatment, and then lengthened towards an end of the surface treatment.

A cycle for moving the mobile base 41 in the crosswise direction relative to the paper surface is not limited, but required time for one reciprocation is preferably 1 to 300 seconds, for example. Whichever this required time for one reciprocation is excessively short or long, such time is unlikely to yield a quality improvement effect of the surface treatment from the variation of the distance between the spray nozzle 22 and the working surface 2*a*. The required time for one reciprocation is more preferably 30 seconds or longer and further preferably 60 seconds or longer, and more preferably 250 seconds or shorter and further preferably 200 seconds or shorter.

Although FIG. 1 shows an example of a provision of the mobile base 41 and the rail 42 for moving the motor 35 and the like, the mobile base 41 and the rail 42 may not be provided in a case where the motor 35 and the like are not moved.

Although FIG. 1 shows an example structure provided with one spray nozzle rotator 31, the number of the spray nozzle rotator 31 is not limited to one, and may be two or more. Upon providing two spray nozzle rotator 31, for example, two workpieces 2 are prepared and disposed in the treatment tank 1 with the working surfaces 2*a* of the workpieces 2 facing outwards. The workpieces 2 are thus disposed in a manner that the spray nozzles 22 are rotated in planes parallel to the respective working surfaces.

Next, another example structure of the first surface treatment apparatus according to the present invention is described with FIG. 4.

FIG. 4 includes a workpiece rotator 61 to rotate a workpiece 2 in a plane perpendicular to a spraying direction of a treatment solution sprayed from a spray nozzle 22. The same portions as those in the above drawings are marked with the same reference signs to avoid a repetition of the descriptions. The first surface treatment apparatus in FIG. 4 is also for subjecting a surface of the workpiece 2 to electrolytic plating.

A treatment tank 1 in FIG. 4 is filled with a solution 3, and in the solution 3 is immersed the workpiece 2. The workpiece 2 has been transferred to the treatment tank 1 by an unillustrated transfer unit, and is inserted into a jig support 53 along a jig guide 54 provided in the jig support 53, then immersed in the treatment tank 1.

In FIG. 4, two workpieces are disposed in the treatment tank 1 with their working surfaces 2*a* and 2*b* facing outwards, and towards the working surfaces 2*a* and 2*b* are provided spray nozzles 22*a* and 22*b* respectively.

The spray nozzles 22*a* and 22*b* communicate respectively with sparger pipes 23*a* and 23*b*, and the sparger pipes 23*a* and 23*b* are fixed in the treatment tank 1 via fastenings 52*a* and 52*b*, and fastenings 55*a* and 55*b*.

In FIG. 4, a circulation path 8 for a circulation of the solution 3 of the treatment tank 1 is also provided, as in FIG. 1. The circulation path 8 branches en route into paths 8*a* and 8*b*, and the paths 8*a* and 8*b* are connected respectively with the sparger pipes 23*a* and 23*b*.

The jig support 53 is attached to the workpiece rotator 61, and the workpieces 2 are configured to rotate in planes perpendicular to spraying directions of the treatment solution sprayed from the spray nozzles 22*a* and 22*b*. That is, the workpieces 2 are held by the jig support 53, and the jig support 53 is connected with a frame 33 via a bracket 34.

Upon connecting the jig support 53 with the workpiece rotator 61, the jig support 53 and the workpiece 2 may be attached, for example, instead of the pipe support 32 and the sparger pipe 23 in FIG. 3 respectively. The jig support 53 is provided with the jig guide 54 as described above, and into the jig support 53 may be inserted the workpieces 2 attached to a jig 5 along the jig guide 54.

The workpieces 2 are rotated in the planes perpendicular to the spraying directions of the treatment solution sprayed from the spray nozzles 22*a* and 22*b* by torque of a motor 35 transmitted to the frame 33 via a shaft, a timing pulley and a timing belt.

Although FIG. 4 shows an example structure provided with two workpiece rotators 61, the number of the workpiece rotator 61 is not limited to two, and may be one, or three or more.

Hereinabove, FIG. 1 showed the first surface treatment apparatus having the spray nozzle rotator to rotate the spray nozzle in the plane parallel to the working surface of the workpiece, and FIG. 4 showed the first surface treatment apparatus having the workpiece rotators to rotate the workpieces in the planes perpendicular to the spraying directions of the treatment solution sprayed from the spray nozzles.

Next, yet another example structure of the first surface treatment apparatus according to the present invention is described with FIGS. 5 and 6. The first surface treatment apparatus in FIG. 5 is an example structure of the first surface treatment apparatus having a spray nozzle rotator to rotate a spray nozzle in a plane parallel to a working surface of a workpiece, as is the first surface treatment apparatus in FIG. 1. FIG. 6 is a cross-sectional view showing the first surface treatment apparatus in FIG. 5 from the direction A.

The first surface treatment apparatus in FIG. 1 and the first surface treatment apparatus in FIG. 5 correspond to one another from a perspective of having a spray nozzle rotator to rotate a spray nozzle, whereas they are different in the following respect. In FIG. 1, the spray nozzle rotator attached to the frame 33 is rotated by the torque of the motor 35 transmitted to the frame 33, whereas in FIGS. 5 and 6, the spray nozzle rotator is attached to a vertical frame 106, and the vertical frame 106 is fixed on a base frame 101 with a shaft 36*i*, a pin 107 and a bearing 39*a* to a bearing 39*d*.

Hereinafter are described details of FIGS. 5 and 6. The same portions as those in FIGS. 1 to 4 are marked with the same reference signs to avoid a repetition of the descriptions. FIGS. 5 and 6 also omit a part of the components in FIGS. 1 to 4.

First, reference is made to FIG. 6. A spray nozzle (a sparger) communicating with a sparger pipe 23 faces a working surface of a workpiece 2, and the sparger pipe 23 is attached to the vertical frame 106. The vertical frames 106 are provided in pairs in a manner that puts a treatment tank 1 between the pair, and they are connected with one another via a horizontal frame 102.

To the vertical frame 106 are fixed the bearing 39*c* and the bearing 39*d*. Through the bearing 39*c* and the bearing 39*d* is provided the pin 107, and both ends of the pin 107 are fixed respectively to places of a plate 105*i* and a plate 105*j* that are shifted from central axes of these plates. To centers of the plate 105*i* and the plate 105*j* are respectively connected the shaft 36*i* and a shaft 36*j*.

On the base frame 101 are fixed the bearing 39*a* and the bearing 39*b*, and with the bearing 39*b* is connected the shaft 36*j* that is through the center of the plate 105*j*. On the other hand, with the bearing 39*a* is connected the shaft 36*i* that is through the center of the plate 105*i*, and an end of the shaft 36*i* is connected with a coupling 104. The coupling 104 is connected a gearbox 103 via a shaft 36*k*.

Next reference is made to FIG. 5. The base frame 101 is a U-shape surrounding a part of the treatment tank 1, and on the base frame 101 is fixed a bearing 39. FIG. 5 shows four bearings 39, but the number of the bearing 39 is not limited thereto. With a gearbox 103*c* is connected a shaft 36*h* apart from the shaft 36*k*, and an end of the shaft 36*h* is connected with the gearbox 103*c*. Also, the shaft 36*h* is fixed by the bearings 39.

The first surface treatment apparatus of the present invention is not limited to these structures, and, for example, may be one in which a spray nozzle is rotated in a plane parallel to a working surface of a workpiece, and the workpiece is rotated in a plane perpendicular to a spraying direction of a treatment solution sprayed from the spray nozzle. That is, both of the spray nozzle and the workpiece may be rotated.

Next, a second surface treatment apparatus of the present invention is described. The second surface treatment apparatus of the present invention is for subjecting a workpiece immersed at least partly in a solution to a surface treatment, and has a spray nozzle for spraying a treatment solution towards a working surface of the workpiece. In addition, the second surface treatment apparatus has a fixing unit that fix the workpiece with inclination relative to a surface of the solution, and a spray nozzle rotator to rotate the spray nozzle.

An example structure of the second surface treatment apparatus of the present invention is described in detail with FIG. 7. Hereinafter is described the second surface treatment apparatus for subjecting a printed board to an electrolytic plating treatment, but the second surface treatment apparatus of the present invention is not limited thereto. The same portions as those in the above drawings are marked with the same reference signs to avoid a repetition of the descriptions.

A spray nozzle in FIG. 7 is the same as that in FIG. 6 from a perspective of rotating around an axis parallel to a surface of a solution. In FIG. 7, however, a workpiece 2 is fixed with inclination relative to the surface of the solution by an unillustrated fixing unit. Inclining the workpiece 2 relative to the surface of the solution removes and discharges bubbles adhering to a surface of the workpiece and to the inside of a recess and a through hole that are formed on the surface of the workpiece. As a result, a treatment solution comes into even contact with the surface of the workpiece, thus being able to reduce treatment unevenness and improve quality of a surface treatment.

An angle θ made between a working surface of the workpiece 2 and the surface of the solution is preferably more than 0 degree and less than 90 degrees. The angle θ is more preferably 20 degrees or more and further preferably 40 degrees or more, and more preferably 80 degrees or less and further preferably 60 degrees or less.

For a workpiece 2 having a through hole, the angle θ made between the working surface of the workpiece 2 and the surface of the solution may be, for example, more than 90 degrees and less than 180 degrees. The angle θ is more preferably 110 degrees or more and further preferably 130 degrees or more, and more preferably 170 degrees or less and further preferably 150 degrees or less.

Next, another example structure of the second surface treatment apparatus of the present invention is described in detail with FIG. 8. Hereinafter is described the second surface treatment apparatus for subjecting a printed board to an electrolytic plating treatment, but the second surface treatment apparatus of the present invention is not limited thereto. The same portions as those in the above drawings are marked with the same reference signs to avoid a repetition of the descriptions.

A spray nozzle in FIG. 8 is the same as that in FIGS. 6 and 7 from a perspective of rotating around an axis parallel to a surface of a solution. Also, FIG. 8 is the same as FIG. 7 from a perspective of fixing a workpiece 2 with inclination relative to the surface of the solution by an unillustrated fixing unit. FIG. 8, however, further includes, on a certain part of a sparger pipe 23, an inclining unit 25 to incline a spray nozzle 22 in a manner that a working surface of the workpiece 2 and a spraying direction of a treatment solution sprayed from the spray nozzle 22 become perpendicular to one another. Adjusting an angle of the inclining unit 25 enables an adjustment of an inclination angle θ1 of the spray nozzle 22 relative to the surface of the solution.

Equalizing an inclination angle θ of the working surface of the workpiece 2 relative to the surface of the solution with the inclination angle θ1 of the spray nozzle 22 relative to the surface of the solution allows the treatment solution to come into even contact with a surface of the workpiece 2, thus being able to reduce treatment unevenness and further improve quality of a surface treatment.

The angles θ and θ1 are preferably more than 0 degree and less than 90 degrees. The angles θ and θ1 are more preferably 20 degrees or more and further preferably 40 degrees or more, and more preferably 80 degrees or less and further preferably 60 degrees or less. For a workpiece 2 having a through hole, the angles θ and θ1 may be, for example, more than 90 degrees and less than 180 degrees. The angle θ is more preferably 110 degrees or more and further preferably 130 degrees or more, and more preferably 170 degrees or less and further preferably 150 degrees or less.

In FIG. 8, a shortest distance from a tip of a spraying hole to the working surface of the workpiece 2 is preferably 10 to 100 mm, for example. When this shortest distance is excessively small, a surface of the workpiece may be damaged by force of the treatment solution. When this shortest distance is excessively large, such a distance necessitates an increase in flow speed at which the treatment solution is sprayed from the spray nozzle. This causes an increased facility load. The shortest distance is more preferably 15 mm or more and further preferably 20 mm or more, and more preferably 90 mm or less and further preferably 80 mm or less.

Next, a third surface treatment apparatus of the present invention is described. The third surface treatment apparatus of the present invention is for subjecting a workpiece immersed at least partly in a solution to a surface treatment, and has a spray nozzle facing the workpiece for spraying a treatment solution towards a working surface of the workpiece. In addition, the third surface treatment apparatus has a spray nozzle rotator to rotate the spray nozzle around an axis parallel to the working surface.

An example structure of the third surface treatment apparatus of the present invention is described in detail with FIG. 9. Hereinafter is described the third surface treatment apparatus for subjecting a printed board to an electrolytic plating treatment, but the third surface treatment apparatus of the present invention is not limited thereto. The same portions as those in the above drawings are marked with the same reference signs to avoid a repetition of the descriptions.

A spray nozzle in FIG. 9 is the same as those in FIGS. 6, 7 and 8 from a perspective of rotating around an axis parallel to a surface of a solution. In FIG. 9, however, a working surface of a workpiece 2 is fixed to become parallel to the surface of the solution by an unillustrated fixing unit, and the working surface of the workpiece 2 and the spray nozzle face one another. That is, in third surface treatment apparatus, a horizontal frame 43 is provided with a sparger pipe 23, and under a spray nozzle 22 of the sparger pipe 23 is disposed the workpiece 2. The spray nozzle and the working surface of the workpiece are parallel to the surface of the solution. A treatment solution sprayed from the spray nozzle 22 is sprayed downwards in a vertical direction. Providing the spray nozzle 22 to face the workpiece 2 and rotating this spray nozzle 22 around an axis parallel to the working surface of the workpiece 2 bring variations to places with which the treatment solution sprayed from the spray nozzle 22 comes into contact and to directions from which the treatment solution makes such contact. This leads to contact of the treatment solution with the workpiece 2 from various directions. As a result, the treatment solution comes into even contact with a surface of the workpiece 2, thus being able to reduce treatment unevenness and improve quality of a surface treatment.

A shortest distance from a tip of a spraying hole of the spray nozzle 22 to the working surface of the workpiece 2 is preferably 10 to 100 mm, for example. When this shortest distance is excessively small, the surface of the workpiece 2 may be damaged by force of the treatment solution. When this shortest distance is excessively large, such a distance necessitates an increase in flow speed at which the treatment solution is sprayed from the spray nozzle 22. This causes an increased facility load. The shortest distance is more preferably 15 mm or more and further preferably 20 mm or more, and more preferably 90 mm or less and further preferably 80 mm or less.

Although an example structure in which the workpiece 2 was fixed was described in FIG. 9, the present invention is not limited to this structure, and may be one in which the workpiece 2 is rotated in a plane perpendicular to a spraying direction of the treatment solution sprayed from the spray nozzle 22.

The third surface treatment apparatus in FIG. 9 may be provided with a spray nozzle rotator to rotate a spray nozzle in a plane parallel to a working surface of a workpiece. This spray nozzle rotator is described in detail with FIG. 10. The same portions as those in the above drawings are marked with the same reference signs to avoid a repetition of the descriptions.

In FIG. 10, with the horizontal frame 43 is connected a vertical frame 44, and with the vertical frame 44 is connected the sparger pipe 23. The sparger pipe 23 has a supply port 45 through which the treatment solution is supplied to the sparger pipe 23. The horizontal frame 43 is provided with a timing pulley 37*f* to 37*i* apart from the vertical frame. The timing pulleys 37*f* and 37*g*, the timing pulleys 37*g* and 37*h*, and the timing pulleys 37*f* and 37*i* are connected respectively with a timing belt 38*d*, a timing belt 38*e*, and a timing belt 38*f* The timing pulley 37*f* and a motor 35 is also connected with a belt.

As shown in FIG. 10, torque of the motor 35 is transmitted to the horizontal frames 43 via the timing pulleys and the timing belts, and the horizontal frames 43 are rotated in a plane parallel to the surface of the solution. By the rotation of the horizontal frame 43 in the plane parallel to the surface of the solution, the vertical frame 44 connected with the horizontal frame 43 is also rotated, resulting in a rotation of the sparger pipe 23.

Next, the spraying hole provided in the first to the third surface treatment apparatuses is described.

[Hole Diameter of Spraying Hole]

A hole diameter of the spraying hole 24 is preferably 1 to 5 mm, for example, but not particularly limited thereto. An excessively small hole diameter leads to excessively strong force of a treatment solution that comes in contact with a workpiece, thus causing damage to a surface of the workpiece in some cases. An excessively large hole diameter increases facility load for spraying a treatment solution from a spray nozzle. The hole diameter is more preferably 1.3 mm or more and further preferably 1.5 mm or more, and more preferably 4 mm or less and further preferably 3 mm or less.

[Average Distance between Spraying Holes Adjacent to One Another]

As to the spraying hole 24, an average distance between the spraying holes adjacent to one another is preferably 5 to 150 mm. An excessively small average distance renders a treatment solution difficult to be sprayed from a spray nozzle. An excessively large average distance causes uneven contact of a treatment solution sprayed from a spray nozzle with a workpiece, thus being unlikely to yield a quality improvement effect of a surface treatment. The average distance is more preferably 10 mm or more and further preferably 30 mm or more, and more preferably 130 mm or less and further preferably 100 mm or less.

The spraying holes 24 may be arranged in a rectangular grid pattern as shown in FIG. 2 (*b*), or in a rhombic grid pattern, a hexagonal grid pattern (sometimes referred to as a staggered pattern), a square grid pattern or a parallel grid pattern.

[Angle of Spraying Direction]

A spraying direction of a treatment solution sprayed from the spraying hole 24 of the spray nozzle 22 is not limited, but an angle of the spraying direction is preferably within a range of −70 degrees to +70 degrees when a horizontal direction is defined to be 0 degree. Whichever this angle of the spraying direction is excessively large in a positive or negative direction, such an angle impedes contact of a treatment solution sprayed from the spray nozzle with a surface of a workpiece, thus being unlikely to yield a quality improvement effect of a surface treatment from spraying the treatment solution. The angle of the spraying direction is more preferably −50 degrees or more and further preferably −30 degrees or more, and more preferably 50 degrees or less and further preferably 30 degrees or less.

An arrangement of the spraying holes 24 of the spray nozzles 22 is also not limited, and angles of the spray nozzles 22 may be adjusted in a manner that all of the spraying holes 24 face in a horizontal direction, a downward direction or an upward direction. Alternatively, the angles of the spray nozzles 22 may be adjusted in a manner that the spraying holes 24 of each of the spray nozzles 22 face individually in the horizontal direction, the downward direction or the upward direction. In addition, a direction of each of the spraying holes 24 may be adjusted.

[Area Ratio]

An area ratio of a space provided with the spraying holes 24 that occupies the spray unit 21 to area of the working surface 2*a* of the workpiece 2 is preferably 100 to 200%, for example. An excessively small area ratio impedes even contact of a treatment solution sprayed from a spray nozzle with a surface of a workpiece, thus being unlikely to yield a quality improvement effect of a surface treatment. Inversely, even a large area ratio saturates an effect yielded from spraying a treatment solution, thus being ineffectual. The area ratio is more preferably 103% or more and further preferably 105% or more, and more preferably 180% or less and further preferably 160% or less.

Next, a procedure for subjecting a workpiece to a surface treatment with the surface treatment apparatus according to the present invention is described. FIG. 11 is a schematic view for describing a procedure for subjecting a workpiece 2 to a surface treatment with the first surface treatment apparatus having the spray nozzle rotator 31 in FIG. 1. The same portions as those in the above drawings are marked with the same reference signs to avoid a repetition of the descriptions.

FIG. 11 (*a*) is a bird's-eye view of a surface treatment facility, and four first surface treatment apparatuses (I to IV) having the spray nozzle rotator 31 are disposed in FIG. 11 (*a*). FIG. 11 (*b*) is a cross-sectional view showing the first surface treatment apparatus represented by II in FIG. 11 (*a*) from the direction A. In FIG. 11, a flux-reflux tank 1*a* is provided adjacent to a treatment tank 1. Although FIG. 11 shows an example structure provided with the flux-reflux tank 1*a*, the flux-reflux tank 1*a* may not be provided.

In FIG. 11, a transfer apparatus for transferring the workpiece 2 is marked with 4*a*, and the transfer apparatus is movable on a rail 71. The first surface treatment apparatuses I to IV are disposed adjacent to the rail 71, and, in FIG. 11 (*a*), the first surface treatment apparatus II is connected with the transfer apparatus 4*a*. The workpiece 2 can be inserted into the first surface treatment apparatus II from the transfer apparatus 4*a*, or retrieved from the first surface treatment apparatus II to the transfer apparatus 4*a*.

FIG. 11 (*b*) shows a connection between the transfer apparatus 4*a* and the first surface treatment apparatus II. The transfer apparatus 4*a* holds the workpiece 2 via a jig 5. FIG. 11 (*b*) shows, with a dotted line, a state of the workpiece 2 immersed in a solution 3 in the treatment tank 1, and a state of the workpiece 2 immersed partly in the solution 3 that is inserted into the flux-reflux tank 1*a*.

Upon inserting the workpiece 2 into the treatment tank 1 from the transfer apparatus 4*a*, a shutter 81*a* provided to the flux-reflux tank 1*a* is firstly lowered, and the workpiece 2 attached to the transfer apparatus 4*a* is slid horizontally, along with the jig 5, to a transfer unit 4, and then inserted into the flux-reflux tank 1*a*. Thereafter, the shutter 81*a* is raised, and the solution 3 is poured into the flux-reflux tank 1*a* until the workpiece 2 in the flux-reflux tank 1*a* is immersed. A shutter 81*b* is then lowered, and the jig 5 with the workpiece 2 is slid to the treatment tank 1. The treatment tank 1 may be filled with the solution 3 in advance. After the transfer of the workpiece 2 to the treatment tank 1, the shutter 81*b* is raised, and a surface of the workpiece 2 may be subjected to a treatment by the spray nozzle rotator 31, which is not illustrated in FIG. 11 (*b*). After the surface treatment of the workpiece 2, the workpiece 2 may be retrieved from the treatment tank 1 by reversing the above procedure.

FIG. 12 is a schematic view for describing a procedure for subjecting a workpiece 2 to a surface treatment with the first surface treatment apparatus having the workpiece rotator 61 in FIG. 4. The same portions as those in the above drawings are marked with the same reference signs to avoid a repetition of the descriptions.

FIG. 12 (*a*) is a bird's-eye view of a surface treatment facility, and four first surface treatment apparatuses (I to IV) having the workpiece rotator 61 are disposed in FIG. 12 (*a*).

FIG. 12 (*b*) is a cross-sectional view showing the first surface treatment apparatus represented by II in FIG. 12 (*a*) from the direction A.

FIG. 12 (*b*) shows a connection between a transfer apparatus 4*a* and the first surface treatment apparatus II. The transfer apparatus 4*a* holds the workpiece 2 via a jig 5. FIG. 12 (*b*) shows, with a dotted line, a state of the workpiece 2 immersed in a solution 3 in a treatment tank 1.

Upon inserting the workpiece 2 into the treatment tank 1 from the transfer apparatus 4*a*, the workpiece 2 attached to the transfer apparatus 4*a* is firstly slid horizontally, along with the jig 5, to a position above the treatment tank 1. The workpiece 2 held via the jig 5 is then hung into the treatment tank 1, and inserted into a jig support 53 provided in the treatment tank 1. On a wall of the jig support 53 may be provided a jig guide 54, as shown in FIG. 4. The treatment tank 1 may be filled with the solution 3 in advance.

After the transfer of the workpiece 2 to the treatment tank 1, a surface of the workpiece 2 may be subjected to a treatment with this workpiece 2 being rotated by the workpiece rotator 61, which is not illustrated in FIG. 12 (*b*). After the surface treatment of the workpiece 2, the workpiece 2 may be retrieved from the treatment tank 1 by reversing the above procedure.

FIG. 12 shows an example structure with one treatment tank in which the workpiece 2 is hung and inserted from the position above the treatment tank 1. The present invention is, however, not limited to this, and may include a structure in which a treatment tank 1 is provided with a shutter on its wall for insertion of a workpiece 2 into the treatment tank 1 from a horizontal direction, and in which a flux-reflux tank 1*a* is provided apart from the treatment tank 1.

FIG. 13 is a schematic view for describing another procedure for subjecting a workpieces 2 to a surface treatment with the first surface treatment apparatus having the spray nozzle rotators 31 in FIG. 1, as is FIG. 11. In FIG. 13, two spray nozzle rotators 31 are provided. Unlike FIG. 11, no flux-reflux tank 1*a* is provided in FIG. 13. The same portions as those in the above drawings are marked with the same reference signs to avoid a repetition of the descriptions.

In FIG. 13, the workpieces 2 are disposed with its working surfaces facing outwards, and spray nozzles face each of the working surfaces respectively. The spray nozzles are rotated in a plane parallel to the working surfaces of the workpieces 2.

As shown in FIG. 13 (*b*), upon inserting the workpieces 2 into a treatment tank 1 from a transfer apparatus 4*a*, the workpieces 2 attached to the transfer apparatus 4*a* is firstly slid horizontally, along with a jig 5, to a position above the treatment tank 1. The workpieces 2 held via the jig 5 is then hung into the treatment tank 1, and the workpieces 2 can be fixed by a jig guide 6 provided in the treatment tank 1. The treatment tank 1 may be filled with a solution 3 in advance.

After the transfer of the workpieces 2 to the treatment tank 1, surfaces of the workpieces 2 may be subjected to a treatment with the spray nozzles being rotated by the spray nozzle rotators 31, which are not illustrated in FIG. 13 (*b*). After the surface treatment of the workpieces 2, the workpieces 2 may be retrieved from the treatment tank 1 by reversing the above procedure.

This application claims the benefit of the priority date of Japanese patent application No. 2017-180414 filed on Sep. 20, 2017. All of the contents of the Japanese patent application No. 2017-180414 filed on Sep. 20, 2017 are incorporated by reference herein.

EXAMPLES

The present invention will be described more concretely by way of Examples below. However, the present invention is by no means limited by the following Examples, and may be certainly practiced after appropriate modifications within a range not deviating from the gist described above and below. All of these are included in the technical scope of the present invention.

A working surface of a workpiece was subjected to a surface treatment with a first surface treatment apparatus in FIG. 1. This workpiece was a printed board having a pattern and a via hole, and this surface treatment was electrolytic plating. On a surface of the workpiece was formed the via hole as a recess. An opening of the via hole had an equivalent circle diameter of 40 μm. Upon the electrolytic plating, a plating bath temperature and an average current density were set to be 30° C. and 10 A/dm$^2$ respectively. Upon the surface treatment, a treatment solution was sprayed towards the working surface of the workpiece from spray nozzle that were being rotated in a plane parallel to the working surface of the workpiece.

The number of the spray nozzle was ten, and a spraying hole of each spray nozzle had a hole diameter of 2 mm. An average distance between the spraying holes adjacent to one another was 50 mm (that is, one spraying hole was vertically and horizontally separated from another at intervals of 50 mm), and a plane arrangement of the spraying holes was a rectangular grid pattern. A spraying direction of the treatment solution sprayed from the spraying holes was a horizontal direction (0 degree). An area ratio of a space provided with the spraying holes to area of the working surface was 110%. A distance between the spraying holes and the working surface was set to be 35 mm.

Upon rotating the spray nozzle, an equivalent circle diameter, a rotational direction and an average rotational speed were set to be 75 mm (a rotational radius was 37.5 mm), a forward direction (a clockwise direction) and 600 mm/min respectively. An average flow speed of the treatment solution sprayed from the spray nozzle was set to be 10 m/sec.

After the surface treatment, the surface of the workpiece was measured by cross-sectional observation to observe whether the recess was plated, and then quality of the surface treatment was evaluated. The evaluation showed that the recess was plated into the depths thereof, and the quality of the surface treatment was favorable.

REFERENCE SIGNS LIST

1 treatment tank
1*a* flux-reflux tank
2 workpiece
2*a*, 2*b* working surface
3 solution
3*a* surface of the solution
4 transfer unit
4*a* transfer apparatus
5 jig
6 jig guide
7 anode
8 circulation path
8*a*, 8*b* path
9 pump
10 filter
21 spray unit
22, 22*a*, 22*b* spray nozzle

23, 23*a*, 23*b* sparger pipe
24 spraying hole
25 inclining units
31 spray nozzle rotator
32 pipe support
33 frame
34 bracket
35 motor
36*a* to 36*e*, 36*i* to 36*k*, 36*h* shaft
37*a* to 37*i* timing pulley
38*a* to 38*f* timing belt
39 bearing
40 frame
41 mobile base
42 rail
43 horizontal frame
44 vertical frame
45 supply port
52*a*, 52*b* fastening
53 jig support
54 jig guide
55*a*, 55*b* fastening
61 workpiece rotator
71 rail
81*a*, 81*b* shutter

The invention claimed is:

1. A surface treatment apparatus for subjecting a workpiece immersed at least partly in a solution to a surface treatment, comprising:

a spray nozzle facing the workpiece for spraying a treatment solution towards a working surface of the workpiece;

a spray nozzle rotator to rotate the spray nozzle in a plane parallel to the working surface of the workpiece;

a treatment tank;

a base frame surrounding a part of the treatment tank; and a vertical frame above the treatment tank, wherein the spray nozzle communicates with a sparger pipe, the sparger pipe is attached to the vertical frame, and the vertical frame is fixed on the base frame with the spray nozzle rotator, a first bearing and a second bearing are fixed to the vertical frame, a pin is provided through the first bearing and the second bearing, the pin having a first end and a second end, the first end of the pin is fixed to a first plate at a location on the first plate that is shifted from a central axis of the first plate, and the second end of the pin is fixed to a second plate at a location on the second plate that is shifted from a central axis of the second plate, a first shaft is connected to a center of the first plate, and a second shaft is connected to a center of the second plate, a third bearing and a fourth bearing are fixed on the base frame, the first shaft is connected with the third bearing, and the second shaft is connected with the fourth bearing, the spray nozzle has a spraying hole having a hole diameter of 1 to 5 mm, a distance between the spraying hole and the workpiece is 10 to 100 mm, the spraying hole is one of a plurality of spraying holes, and an average distance between adjacent ones of the spraying holes is 5 to 150 mm, and a direction of the spray nozzle is such that an angle of the spraying direction of the treatment solution sprayed from the spray nozzle is −70 degrees to +70 degrees when a horizontal direction is defined to be 0 degrees.

2. The surface treatment apparatus according to claim 1, wherein at least one of the workpiece or the spray nozzle is rotated at an average rotational speed of 100 to 3,000 mm/min.

3. The surface treatment apparatus according to claim 1, wherein at least one of the workpiece or the spray nozzle is rotated with an equivalent circle diameter of 20 to 200 mm.

4. The surface treatment apparatus according to claim 1, wherein the spray nozzle sprays the treatment solution at an average flow speed of 1 to 30 m/sec.

5. The surface treatment apparatus according to claim 1, further comprising:

a circulation path for a circulation of the treatment solution from the treatment tank of the surface treatment apparatus to the spray nozzle; and a pump on the circulation path for circulating the treatment solution from the treatment tank.

6. The surface treatment apparatus according to claim 1, wherein the surface treatment is a plating treatment, and a plating bath temperature is 20 to 50° C.

7. The surface treatment apparatus according to claim 1, wherein the surface treatment is an electrolytic plating treatment, and an average current density is 1 to 30 A/dm$^2$.

8. The surface treatment apparatus according to claim 1, further comprising a workpiece rotator to rotate the workpiece in a plane perpendicular to a spraying direction of the treatment solution sprayed from the spray nozzle.

* * * * *